US011128031B2

(12) United States Patent
Ryoo et al.

(10) Patent No.: US 11,128,031 B2
(45) Date of Patent: Sep. 21, 2021

(54) CHIP ANTENNA MODULE ARRAY AND CHIP ANTENNA MODULE

(71) Applicant: Samsung Electro-Mechanics Co., Ltd., Suwon-si (KR)

(72) Inventors: Jeong Ki Ryoo, Suwon-si (KR); Ju Hyoung Park, Suwon-si (KR); Nam Ki Kim, Suwon-si (KR); Dae Ki Lim, Suwon-si (KR); Won Cheol Lee, Suwon-si (KR); Hong In Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/822,776

(22) Filed: Mar. 18, 2020

(65) Prior Publication Data

US 2021/0175609 A1 Jun. 10, 2021

(30) Foreign Application Priority Data

Dec. 6, 2019 (KR) ..... 10-2019-0161308

(51) Int. Cl.
*H01Q 1/22* (2006.01)
*H01Q 1/24* (2006.01)
(Continued)

(52) U.S. Cl.
CPC ..... *H01Q 1/2283* (2013.01); *H01Q 1/243* (2013.01); *H01Q 9/045* (2013.01); *H01Q 9/0414* (2013.01); *H01Q 21/065* (2013.01)

(58) Field of Classification Search
CPC ..... H01Q 1/2283; H01Q 1/243; H01Q 9/045; H01Q 21/065; H01Q 9/0414
See application file for complete search history.

(56) References Cited

U.S. PATENT DOCUMENTS

2016/0104934 A1* 4/2016 Jang ..... H01Q 21/062 343/834
2018/0337148 A1 11/2018 Baek et al.
(Continued)

FOREIGN PATENT DOCUMENTS

JP 4128129 B2 7/2008
KR 10-1572037 B1 11/2015
(Continued)

OTHER PUBLICATIONS

Korean Office Action dated Oct. 15, 2020 in counterpart Korean Patent Application No. 10-2019-0161308 (6 pages in English, 5 pages in Korean).

*Primary Examiner* — Daniel D Chang
(74) *Attorney, Agent, or Firm* — NSIP Law

(57) ABSTRACT

A chip antenna module array includes a connection member and chip antenna modules mounted on the connection member. Each chip antenna module includes: a first patch antenna dielectric layer; a feed via extending through the first patch antenna dielectric layer; and a patch antenna pattern disposed on an upper surface of the first patch antenna dielectric layer and configured to be fed from the feed via. At least one chip antenna module includes: a ground pattern disposed on a lower surface of the first patch antenna dielectric layer; a chip-antenna feed line including a second part disposed on a lower surface of the ground pattern, and electrically connecting a connection member feed line to the feed via; a first feed line dielectric layer disposed on a lower surface of the second part; and a solder layer disposed on a lower surface of the first feed line dielectric layer.

19 Claims, 25 Drawing Sheets

(51) Int. Cl.
*H01Q 21/06* (2006.01)
*H01Q 9/04* (2006.01)

(56) References Cited

U.S. PATENT DOCUMENTS

| | | | | |
|---|---|---|---|---|
| 2019/0326672 | A1* | 10/2019 | Lim | H01Q 1/2283 |
| 2020/0259267 | A1* | 8/2020 | Park | H01Q 1/48 |
| 2020/0313279 | A1* | 10/2020 | Kim | H01Q 21/28 |
| 2021/0036407 | A1* | 2/2021 | Kim | H01Q 1/243 |

FOREIGN PATENT DOCUMENTS

| | | | |
|---|---|---|---|
| KR | 10-2016-0042740 | A | 4/2016 |
| KR | 10-2019-0123195 | A | 10/2018 |
| KR | 10-2018-0127144 | A | 11/2018 |

* cited by examiner

CHIP ANTENNA MODULE ARRAY AND CHIP ANTENNA MODULE

CROSS-REFERENCE TO RELATED APPLICATIONS

This application claims the benefit under 35 USC § 119(a) of Korean Patent Application No. 10-2019-0161308 filed on Dec. 6, 2019 in the Korean Intellectual Property Office, the entire disclosure of which is incorporated herein by reference for all purposes.

BACKGROUND

1. Field

The following description relates to a chip antenna module array and a chip antenna module.

2. Description of Related Art

Mobile communications data traffic has been increasing rapidly on a yearly basis. Technology has been developed to support rapid data transfer in real time in a wireless network. For example, applications such as contents of Internet of Things (IoT)-based data, augmented reality (AR), Virtual Reality (VR), live VR/AR combined with SNS, autonomous driving, Sync View (real-time image transmission from the user's point view using an ultra-small camera), and the like, may require communications, such as 5G communications, mmWave communications, and the like, supporting the transmission and reception of large amounts of data.

Thus, in recent years, millimeter wave (mmWave) communications including fifth generation (5G) communications have been researched, and research into the commercialization/standardization of chip antenna modules for smoothly implementing communications has been conducted.

An RF signal in a high frequency band (for example: 24 GHz, 28 GHz, 36 GHz, 39 GHz, 60 GHz, and the like) is easily absorbed in a transmission process and may therefore experience loss. Thus, a quality of communications may be dramatically reduced. Therefore, an antenna for communications in a high frequency band may demand a different configuration than that of conventional antenna technology, and special technological development such as an additional power amplifier for ensuring antenna gain, integration of an antenna and an RFIC, and ensuring effective isotropic radiated power (EIRP) may be implemented.

SUMMARY

This Summary is provided to introduce a selection of concepts that are further described below in the Detailed Description in simplified form. This Summary is not intended to identify key features or essential features of the claimed subject matter, nor is it intended to be used as an aid in determining the scope of the claimed subject matter.

In one general aspect, a chip antenna module array includes a connection member including: wiring vias spaced apart from each other and extending in a vertical direction; at least one connection member feed line electrically connected to a corresponding wiring via among the wiring vias, and extending in a horizontal direction; and chip antenna modules spaced apart from each other and mounted on an upper surface of the connection member. Each of the chip antenna modules includes: a first patch antenna dielectric layer; a feed via extending through the first patch antenna dielectric layer; and a patch antenna pattern disposed on an upper surface of the first patch antenna dielectric layer and configured to be fed from the feed via. At least one of the chip antenna modules includes: a ground pattern disposed on a lower surface of the first patch antenna dielectric layer; a chip-antenna feed line including first, second, and third parts connected to each other in series, disposed such that the second part is disposed on a lower surface of the ground pattern, and electrically connecting the at least one connection member feed line and the feed via to each other; a first feed line dielectric layer disposed on a lower surface of the second part of the chip-antenna feed line; and a solder layer disposed on a lower surface of the first feed line dielectric layer and configured to support mounting of at least one of the chip antenna modules.

The at least one of the chip antenna modules may further include: a third feed line dielectric layer disposed between the ground pattern and the first feed line dielectric layer; and a second feed line dielectric layer disposed between the first and third feed line dielectric layers, and disposed in contact with at least a portion of the chip-antenna feed line.

The second feed line dielectric layer may have a dielectric constant less than a dielectric constant of each of the first and third feed line dielectric layers.

The at least one of the chip antenna modules may further include a feed line surrounding pattern disposed between the first and third feed line dielectric layers and configured to at least partially surround the chip-antenna feed line.

The at least one of the chip antenna modules may further include feed line surrounding vias arranged to at least partially surround the chip-antenna feed line. Each of the feed line surrounding vias may electrically connect the feed line surrounding pattern and the ground pattern to each other.

The at least one of the chip antenna modules may further include: a side feed line disposed between the first and third feed line dielectric layers and electrically connected to the connection member through the first feed line dielectric layer; and a side radiation pattern disposed between the first and third feed line dielectric layers and electrically connected to the side feed line.

The at least one of the chip antenna modules may further include: a side feed line disposed between the ground pattern and the first feed line dielectric layer, and electrically connected to the connection member through the first feed line dielectric layer; and a side radiation pattern electrically connected to the side feed line and disposed closer to a side surface of the first patch antenna dielectric layer than to the side feed line.

At least a portion of the side radiation pattern may be disposed on the side surface of the first patch antenna dielectric layer or a side surface of the first feed line dielectric layer.

The side radiation pattern may be electrically connected to the solder layer.

The patch antenna pattern may include a first patch antenna pattern and a second patch antenna pattern. The at least one of the chip antenna modules may further include: a third patch antenna dielectric layer disposed on an upper surface of the first patch antenna pattern; and a second patch antenna dielectric layer disposed between the first and third patch antenna dielectric layers. The second patch antenna pattern may be disposed on an upper surface of the third patch antenna dielectric layer.

The first feed line dielectric layer may include a ceramic material and may have a dielectric constant higher than a dielectric constant of an insulating layer of the connection member.

The first patch antenna dielectric layer may have a dielectric constant higher than the dielectric constant of the first feed line dielectric layer.

The connection member may form a space in which an integrated circuit (IC) is disposed. The feed via of each of the chip antenna modules may be electrically connected to the IC through the connection member.

In another general aspect, a chip antenna module includes: a first patch antenna dielectric layer; a feed via extending through the first patch antenna dielectric layer; a patch antenna pattern disposed on an upper surface of the first patch antenna dielectric layer and configured to be fed from the feed via; a ground pattern disposed on a lower surface of the first patch antenna dielectric layer; a chip-antenna feed line including first, second, and third parts connected to each other in series, disposed such that the second part is disposed on a lower surface of the ground pattern, and electrically connecting at least one connection member feed line and the feed via to each other; a first feed line dielectric layer disposed on a lower surface of the second part; a side feed line disposed between the ground pattern and the first feed line dielectric layer, and spaced apart from the chip-antenna feed line; a side radiation pattern electrically connected to the side feed line and disposed closer to a side surface of the first patch antenna dielectric layer than to the side feed line; and a solder layer disposed on a lower surface of the first feed line dielectric layer.

At least a portion of the side radiation pattern may be disposed on the side surface of the first patch antenna dielectric layer or a side of the first feed line dielectric layer.

The side radiation pattern may be electrically connected to the solder layer.

The side radiation pattern may have a resonant frequency lower than a resonant frequency of the patch antenna pattern.

The chip antenna module may further include: a third feed line dielectric layer disposed between the ground pattern and the first feed line dielectric layer; and a second feed line dielectric layer disposed in contact with at least a portion of the chip-antenna feed line, wherein the side radiation pattern is disposed between the first and third feed line dielectric layers.

The chip antenna module may further include: a second patch antenna dielectric layer disposed on an upper surface of the first patch antenna dielectric layer; and a third patch antenna dielectric layer disposed on an upper surface of the second patch antenna dielectric layer. The patch antenna pattern may include: a first patch antenna pattern disposed between the first and third patch antenna dielectric layers; and a second patch antenna pattern disposed on an upper surface of the third patch antenna dielectric layer.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
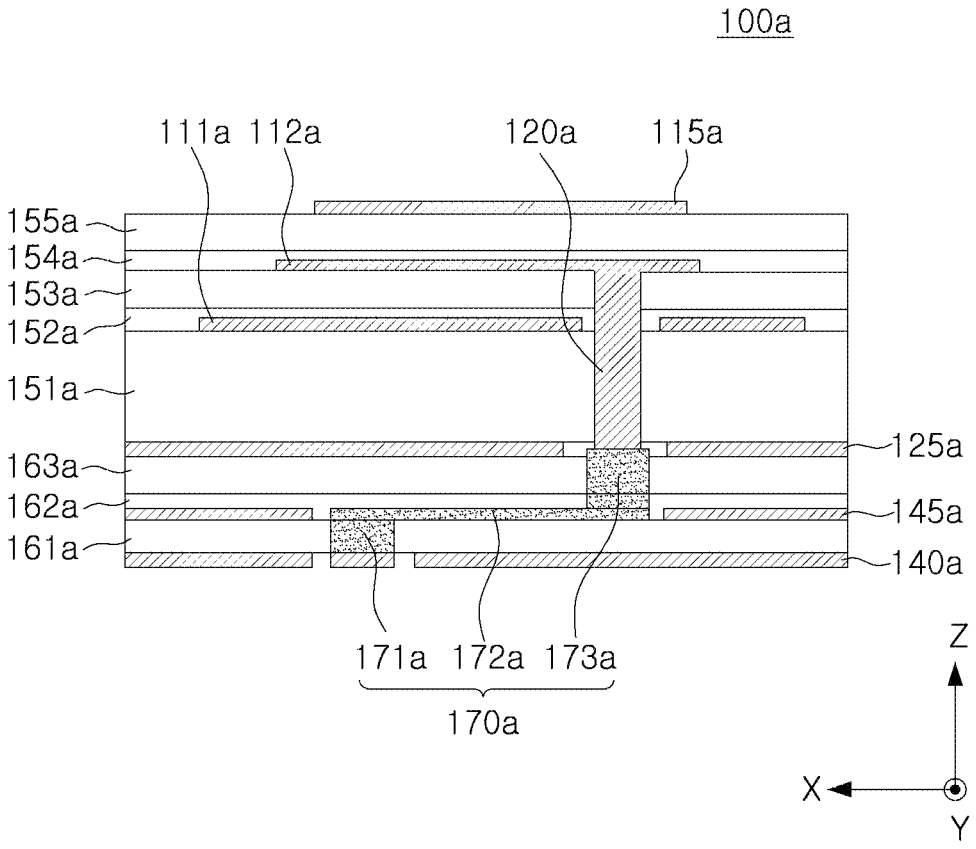
FIGS. 1A and 1B are side views illustrating chip antenna modules in a chip antenna module arrays, according to embodiments.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, for example, as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
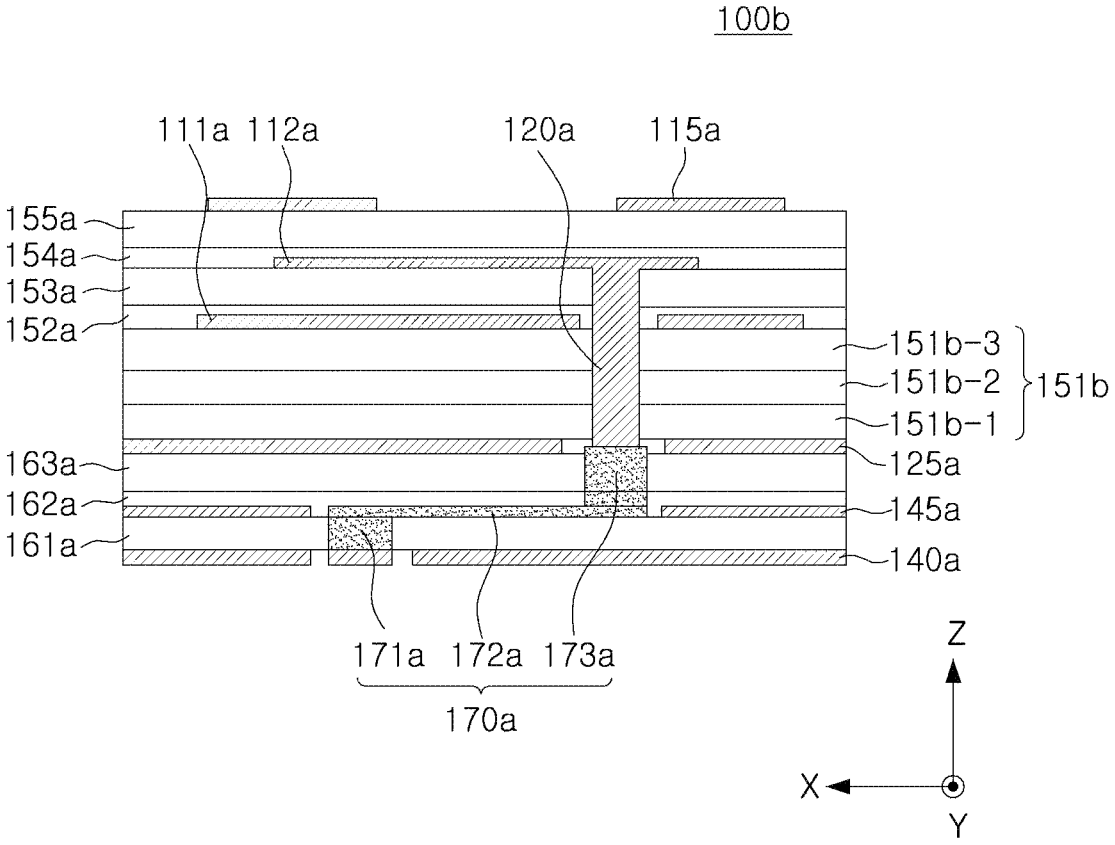
Figure 2A:
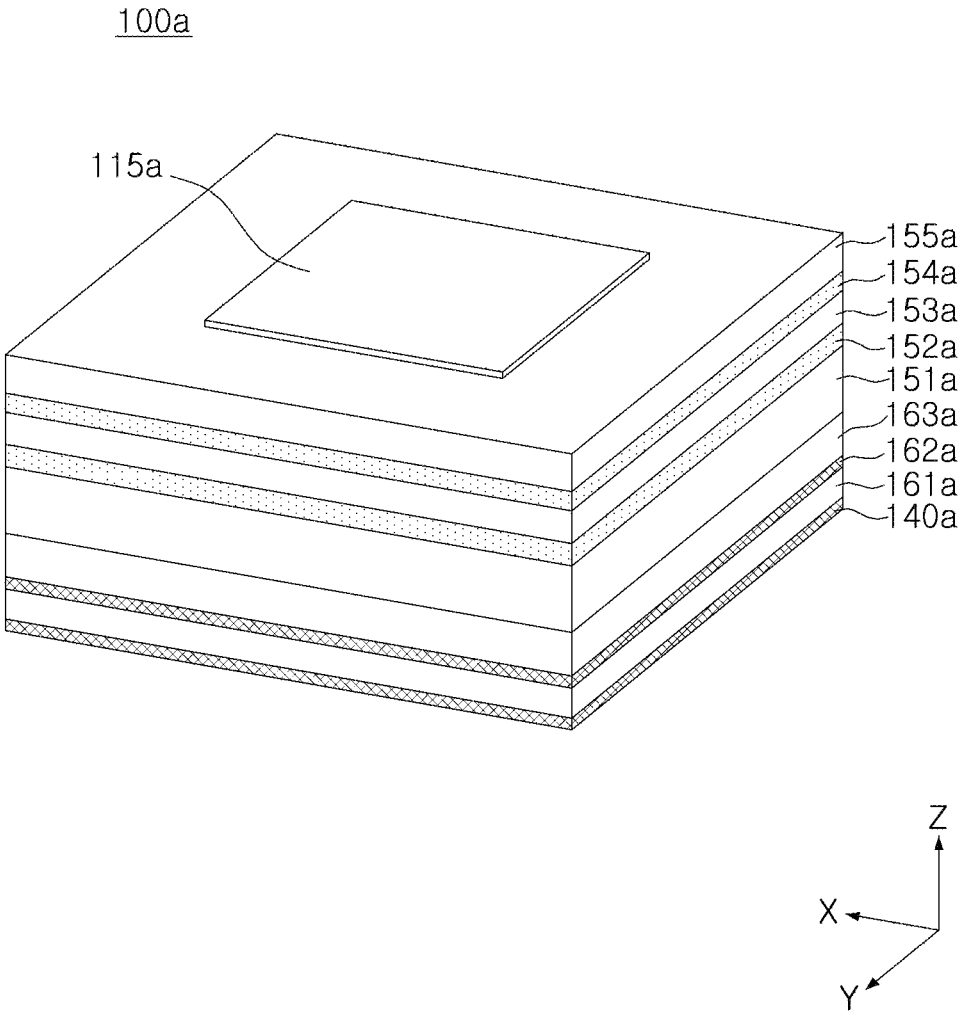
FIGS. 2A and 2B are perspective views of chip antenna modules in chip antenna module arrays, according to embodiments.

FIGS. 1A and 1B are side views illustrating chip antenna modules in chip antenna module arrays, according to embodiments. FIG. 2A is a perspective view of a chip antenna module in a chip antenna module array, according to an embodiment.

Referring to FIGS. 1A and 2A, at least one chip antenna module 100*a* in a chip antenna module array, according to an embodiment, may include a first patch antenna dielectric layer 151*a*, a feed via 120*a*, a first patch antenna pattern 111*a*, a second patch antenna pattern 112*a*, a ground pattern 125*a*, a chip-antenna feed line 170*a*, a first feed line dielectric layer 161*a*, and a solder layer 140*a*.

An upper surface of the first patch antenna dielectric layer 151*a* may be used as a space on which the first patch antenna pattern 111*a* is disposed, and a lower surface of the first patch antenna dielectric layer 151*a* may be used as a space on which the ground pattern 125*a* is disposed.

The first patch antenna dielectric layer 151*a* may form a path of a radio-frequency (RF) signal radiated through a lower surface of the first patch antenna pattern 111*a*. The RF signal may have a wavelength corresponding to a dielectric constant of the first patch antenna dielectric layer 151*a* in the first patch antenna dielectric layer 151*a*.

A spacing distance between the first patch antenna pattern 111*a* and the ground pattern 125*a* may be optimized based on a wavelength of the RF signal, and may be more easily shortened as the wavelength of the RF signal is reduced. Accordingly, a thickness of the first patch antenna dielectric layer 151*a* in a vertical direction (for example, a Z direction) may be more easily reduced as the dielectric constant of the first patch antenna dielectric layer 151*a* is increased.

A size of each of the first patch antenna pattern 111*a* and the ground pattern 125*a* in a horizontal direction (for example, an X direction and/or a Y direction) may be optimized based on the wavelength of the RF signal, and may be more easily reduced as the wavelength of the RF signal is reduced. Accordingly, a size of the first patch antenna dielectric layer 151*a* in the horizontal direction (for example, the X direction and/or the Y direction) may be more easily reduced as the dielectric constant of the first patch antenna dielectric layer 151*a* is increased.

Thus, an overall size of the chip antenna module 100*a* may be more easily reduced as the dielectric constant of the first patch antenna dielectric layer 151*a* is increased.

In general, a patch antenna may be implemented as a portion of a substrate such as a printed circuit board (PCB), but miniaturization of the patch antenna may be limited due to a relatively low dielectric constant of a common insulating layer of the printed circuit board (PCB).

Since the chip antenna module 100*a* may be manufactured independently of a substrate such as a printed circuit board (PCB), the first patch antenna dielectric layer 151*a*, having a dielectric constant higher than a dielectric constant of a common insulating layer of a printed circuit board (PCB), may be more easily used.

For example, the first patch antenna dielectric layer 151*a* may include a ceramic material configured to have a dielectric constant higher than a dielectric constant of a common insulating layer of a printed circuit board (PCB).

For example, the first patch antenna dielectric layer 151*a* may include a material having a relatively high dielectric constant, for example, a ceramic-based material having a relatively high dielectric constant such as low temperature co-fired ceramic (LTCC) or a glass-based material. The first patch antenna dielectric layer 151*a* may be configured to have a higher dielectric constant or stronger durability by further containing any one or any combination of any two or more of magnesium (Mg), silicon (Si), aluminum (Al), calcium (Ca), and titanium (Ti). For example, the first patch antenna dielectric layer 151*a* may include $Mg_2SiO_4$, $MgAlO_4$, or $CaTiO_3$.

The feed via 120*a* may be disposed to penetrate through the first patch antenna dielectric layer 151*a*. For example, the feed via 120*a* may be formed in a process of filling a through-hole, formed in the first patch antenna dielectric layer 151*a* by laser, with a conductive material (for example, copper, nickel, tin, silver, gold, palladium, or the like).

The first patch antenna pattern 111*a* and/or the second patch antenna patterns 112*a* may be fed from the feed via 120*a*. One of the first and second patch antenna patterns 111*a* and 112*a* may be omitted depending on a design, and the first and second patch antenna patterns 111*a* and 112*a* may be configured to have different resonance frequencies to each other. For example, the first patch antenna pattern 111*a* and/or the second patch antenna patterns 112*a* may be formed as a conductive paste is dried while being applied and/or filled on a patch antenna dielectric layer.

The first patch antenna pattern 111*a* may be indirectly fed from the feed via 120*a*, and the second patch antenna pattern 112*a* may be directly fed from the feed via 120*a*. However, the feeding of the first and second patch antenna patterns 111*a* and 112*a* is not limited to such a configuration. For example, the first patch antenna pattern 111*a* may be configured to be in contact with the feed via 120*a*, and the second patch antenna pattern 112*a* may be configured to be fed from a separate feed via. The second patch antenna pattern 112*a* may be a parasitic patch depending on a configuration.

The wavelength of the RF signal, as radiated from the first patch antenna pattern 111*a* and/or the second patch antenna patterns 112*a*, may correspond to a size of the first patch antenna pattern 111*a* and/or the second patch antenna patterns 112*a* in the horizontal direction (for example, the X direction and/or the Y direction). Accordingly, the first patch antenna pattern 111*a* and/or the second patch antenna patterns 112*a* may be configured to form a radiation pattern in the vertical direction (for example, the Z direction) while resonating.

The ground pattern 125*a* may be capacitively coupled to the first patch antenna pattern 111*a* and/or the second patch antenna patterns 112*a*, and may reflect the RF signal, after the RF signal is radiated from a lower surface of the first patch antenna pattern 111*a* and/or the second patch antenna patterns 112*a*. The RF signal, after being reflected from the ground pattern 125*a*, may overlap the RF signal radiated through an upper surface of the first patch antenna pattern 111*a* and/or the second patch antenna patterns 112*a*. Accordingly, since the radiation pattern of the first patch antenna pattern 111*a* and/or the second patch antenna patterns 112*a* may be further concentrated in the vertical direction (for example, the Z direction), a gain of the first patch antenna pattern 111*a* and/or the second patch antenna patterns 112*a* may be further increased.

At least a portion of the chip-antenna feed line 170*a* may be horizontally disposed on a lower surface of the ground pattern 125*a*. The chip-antenna feed line 170*a* may form electrical connection between the feed via 120*a* and the connection member.

For example, the chip-antenna feed line 170*a* may include first, second, and third parts 171*a*, 172*a*, and 173*a*.

The third part 173*a* of the chip-antenna feed line 170*a* may have a shape extending in the vertical direction (for example, the Z direction) to be in contact with the feed via 120*a*.

The second part 172*a* of the chip-antenna feed line 170*a* may be connected to the third part 173*a* and may be horizontally disposed on an upper surface of the first feed line dielectric layer 161*a*.

The first part 171*a* of the chip-antenna feed line 170*a* may be connected to the second part 172*a*, and may be disposed to penetrate through the first feed line dielectric layer 161*a*. The first part 171*a* of the chip-antenna feed line 170*a* may be connected to the connection member.

The upper surface of the first feed line dielectric layer 161*a* may include a space on which at least a portion of the chip-antenna feed line 170*a* is disposed.

Thus, dielectric loss of the first feed line dielectric layer 161*a* may affect transmission loss of the RF signal transmitted to the first patch antenna pattern 111*a* and/or the second patch antenna patterns 112*a* through the chip-antenna feed line 170*a*.

Since the chip antenna module 100*a* may be manufactured independently of a substrate such as a printed circuit board (PCB), the first feed line dielectric layer 161*a*, having less dielectric loss than the insulating layer of the substrate, may be more easily used. Thus, the gain of the chip antenna module 100*a* may be further increased.

For example, the first feed line dielectric layer 161*a* may include ceramic configured to have a dielectric loss (for example, 0.0008) lower than a dielectric loss (for example, 0.004) of a common insulating layer of a printed circuit board (PCB). For example, the first feed line dielectric layer 161*a* may include the same material as the first patch antenna dielectric layer 151*a*.

For example, the first feed line dielectric layer 161*a* may have a dielectric constant less than a dielectric constant of the first patch antenna dielectric layer 151*a*. For example, since the first patch antenna dielectric layer 151*a* contributes relatively more to an overall size of the chip antenna module 100*a*, the first patch antenna dielectric layer 151*a* may have a relatively higher dielectric constant to reduce the overall size of the chip antenna module 100*a*. Since the first feed line dielectric layer 161*a* contributes relatively less to the overall size of the chip antenna module 100*a*, a configuration may be implemented to focus more on a reduction in transmission loss of the chip-antenna feed line 170*a* than on the overall size of the chip antenna module 100*a*.

The solder layer 140*a* may be disposed on a lower surface of the first feed line dielectric layer 161*a*. The solder layer 140*a* may be configured to support mounting of the connection member of the chip antenna module 100*a*. For example, the solder layer 140*a* may be disposed along an edge of the first feed line dielectric layer 161*a* to enable the solder layer 140*a* to be more easily connected to the connection member. For example, the solder layer 140*a* may be configured to be advantageous for connection to a solder based on tin (Sn) having a relatively low melting point, and may include a tin plating layer and/or a nickel plating layer enabling easy connection to the solder.

Referring to FIGS. 1A and 2A, the chip antenna module 100*a* may further include at least one a second patch antenna dielectric layer 152*a*, a third patch antenna dielectric layer 153*a*, a fourth patch antenna dielectric layer 154*a*, a fifth patch antenna dielectric layer 155*a*, a second feed line dielectric layer 162*a*, and a third feed line dielectric layer 163*a*.

For example, the third and fifth patch antenna dielectric layers 153*a* and 155*a* may include the same material as the first patch antenna dielectric layer 151*a*, the third feed line dielectric layer 163*a* may include the same material as the first feed line dielectric layer 161*a*, and the second feed line dielectric layer 162*a* and the second and fourth patch antenna dielectric layers 152*a* and 154*a* may include the same material.

For example, the second feed line dielectric layer 162*a* and the second and fourth patch antenna dielectric layers 152*a* and 154*a* may include a material different from a material of the first, third, and fifth patch antenna dielectric layers 151*a*, 153*a*, and 155*a*. For example, the second feed line dielectric layer 162*a* and the second and fourth patch antenna dielectric layers 152*a* and 154*a* may include a polymer having adhesion to enhance binding force between the first and third feed line dielectric layers 161*a* and 163*a* and binding force between the first, third, and fifth patch antenna dielectric layers 151*a*, 153*a*, and 155*a*. For example, the second feed line dielectric layer 162*a* and the second and fourth patch antenna dielectric layers 152*a* and 154*a* may include ceramic, having a dielectric constant lower than a dielectric constant of each of the first, third, and fifth patch antenna dielectric layers 151*a*, 153*a*, and 155*a*, to form dielectric medium boundaries between the first and third patch antenna dielectric layers 151*a* and 153*a* between the third and fifth patch antenna dielectric layers 153*a* and 155*a*. Alternatively, the second feed line dielectric layer 162*a* and the second and fourth patch antenna dielectric layers 152*a* and 154*a* may include a material having a high flexibility such as a liquid crystal polymer (LCP) or polyimide, or may include a material such as an epoxy resin or Teflon to have high durability and high adhesion.

The third feed line dielectric layer 163*a* may be disposed between the ground pattern 125*a* and the first feed line dielectric layer 161*a*.

The second feed line dielectric layer 162*a* may be disposed between the first and third feed line dielectric layers 161*a* and 163*a*, and may be disposed to be in contact with at least a portion of the chip-antenna feed line 170*a*.

Due to a laminated structure of the first, second, and third feed line dielectric layers 161*a*, 162*a*, and 163*a*, the chip-antenna feed line 170*a* may include the first, second, and third parts 171*a*, 172*a*, and 173*a*. Accordingly, an electrical length of the chip-antenna feed line 170*a* may be more precisely designed. Therefore, a phase of the RF signal, as radiated from the chip antenna module 100*a*, may be more precisely adjusted and radiation patterns of the chip antenna modules 100*a* may more efficiently overlap each other.

Since the dielectric constant of the second feed line dielectric layer 162*a* may be lower than the dielectric constant of each of the first and third feed line dielectric layers 161*a* and 163*a*, the second feed line dielectric layer 162*a* may be configured to focus on the first and third feed line. The second feed line dielectric layer 162*a* may be configured to focus more on the enhancement of adhesion between the first and third dielectric layers 161*a* and 163*a*. Accordingly, the laminated structure of the first, second, and third feed line dielectric layers 161*a*, 162*a*, and 163*a* may be more stable, and the possibility of short-circuits and leakage current of the chip-antenna feed line 170*a* may be further reduced.

The second patch antenna dielectric layer 152*a* may be disposed between the first and third patch antenna dielectric layers 151*a* and 153*a* and may be configured to increase the binding force between the first and third patch antenna dielectric layers 151*a* and 153*a*. A dielectric constant of each of the first and third patch antenna dielectric layers 151*a* and 153*a* may be lower than a dielectric constant of each of the first and third patch antenna dielectric layers 151*a* and 153*a* to form a dielectric medium boundary between the first and third patch antenna dielectric layers 151*a* and 153*a*. Since the dielectric medium boundary may refract a propagation direction of the RF signal radiated from the first patch antenna pattern 111*a* and/or the second patch antenna pattern 112*a*, a gain may be further increased.

The third patch antenna dielectric layer 153*a* may be disposed on an upper surface of the first patch antenna pattern 111*a*, and an upper surface of the third patch antenna dielectric layer 153*a* may include a space on which the second patch antenna pattern 112*a* is disposed.

The fourth patch antenna dielectric layer 154*a* may be disposed on an upper surface of the third patch antenna dielectric layer 153*a*, and the fifth patch antenna dielectric layer 155*a* may be disposed on an upper surface of the fourth patch antenna dielectric layer 154*a*. Since a dielectric medium boundary between the third and fifth patch antenna dielectric layers 153*a* and 155*a* may refract the propagation direction of the RF signal radiated from the first patch antenna pattern 111*a* and/or the second patch antenna pattern 112*a*, the gain of the first patch antenna pattern 111*a* and/or the second patch antenna pattern 112*a* may be further increased.

Referring to FIGS. 1A and 2A, the chip antenna module 100*a* may further include either one or both of a third patch antenna pattern 115*a* and a feed line surrounding pattern 145*a*.

The third patch antenna pattern 115*a* may be disposed on an upper surface of the fifth patch antenna dielectric layer 155*a* and electromagnetically coupled to the first patch antenna pattern 111*a* and/or the second patch antenna pattern 112*a*. Therefore, a bandwidth of the first patch antenna pattern 111*a* and/or the second patch antenna pattern 112*a* may be further increased.

The feed line surrounding pattern 145*a* may be disposed between the first and third feed line dielectric layers 161*a* and 163*a* and may be configured to surround the chip-antenna feed line 170*a*. Accordingly, since the chip-antenna feed line 170*a* may be protected from external electromagnetic noise, noise of the RF signal transmitted through the chip-antenna feed line 170*a* may be further reduced.

Referring to FIG. 1B, in an antenna module 100*b*, a third patch antenna pattern 115*b* may have a slot in a central portion thereof. Accordingly, since surface current flowing through the third patch antenna pattern 115*a* may flow in a direction rotating around the slot, a size of the third patch antenna pattern 115*a* depending on optimization of a wavelength of the RF signal may be further decreased.

Referring to FIG. 1B, the first patch antenna dielectric layer 151*b* of the chip antenna module 100*b* may include a 1-1-th patch antenna dielectric layer 151*b*-1, a 1-2-th patch antenna dielectric layer 151*b*-2, and a 1-3-th patch antenna dielectric layer 151*b*-3.

The 1-2-th patch antenna dielectric layer 151*b*-2 may include the same material as the second and fourth patch antenna dielectric layers 152*a* and 154*a*, and may have a dielectric constant lower than a dielectric constant of each of the 1-1-th patch antenna dielectric layer 151*b*-1 and the 1-3-th patch antenna dielectric layer 151*b*-3.

Accordingly, since the first patch antenna dielectric layer 151*b* may form a dielectric medium boundary between the first patch antenna pattern 111*a* and/or the second patch antenna pattern 112*a* and the ground pattern 125*a*, formation of a radiation pattern of the first patch antenna pattern 111*a* and/or the second patch antenna pattern 112*a* may be further concentrated in the vertical direction (for example, the Z direction).

Figure 1C:
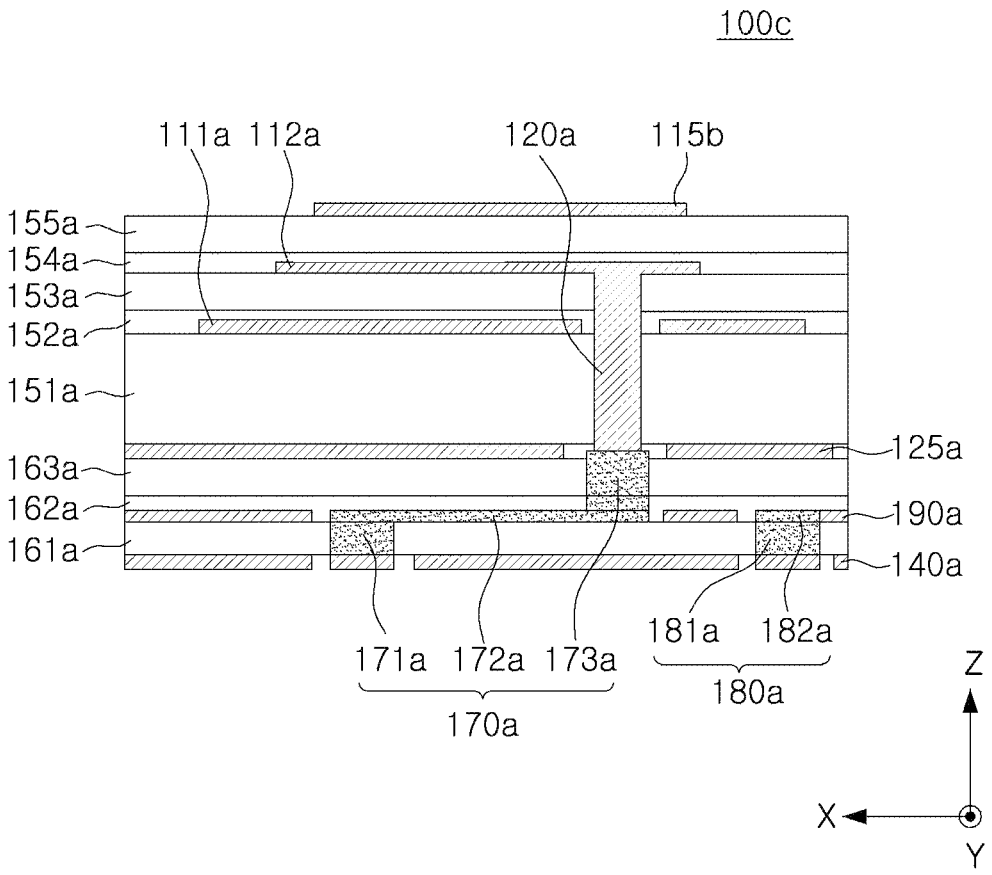
FIGS. 1C and 1D are side views illustrating a structure in which a side feed line and/or a side radiation pattern are additionally provided in a chip antenna module in a chip antenna module array, according to an embodiment.
Figure 1D:
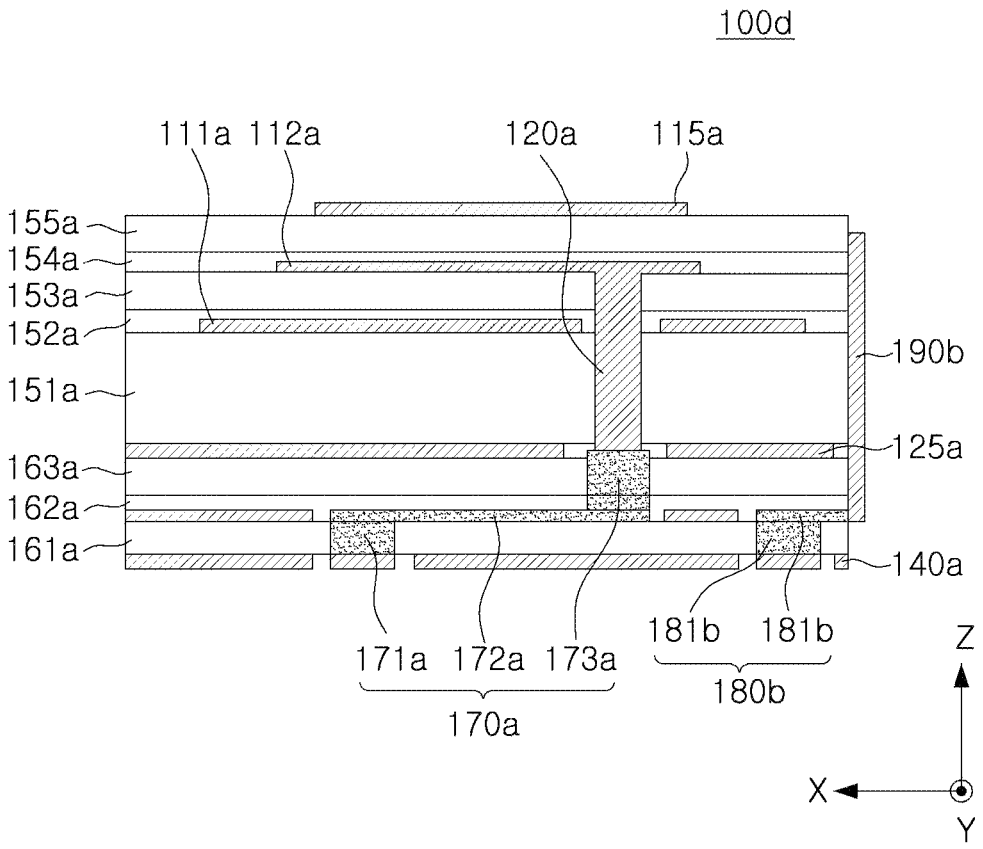
Figure 2B:
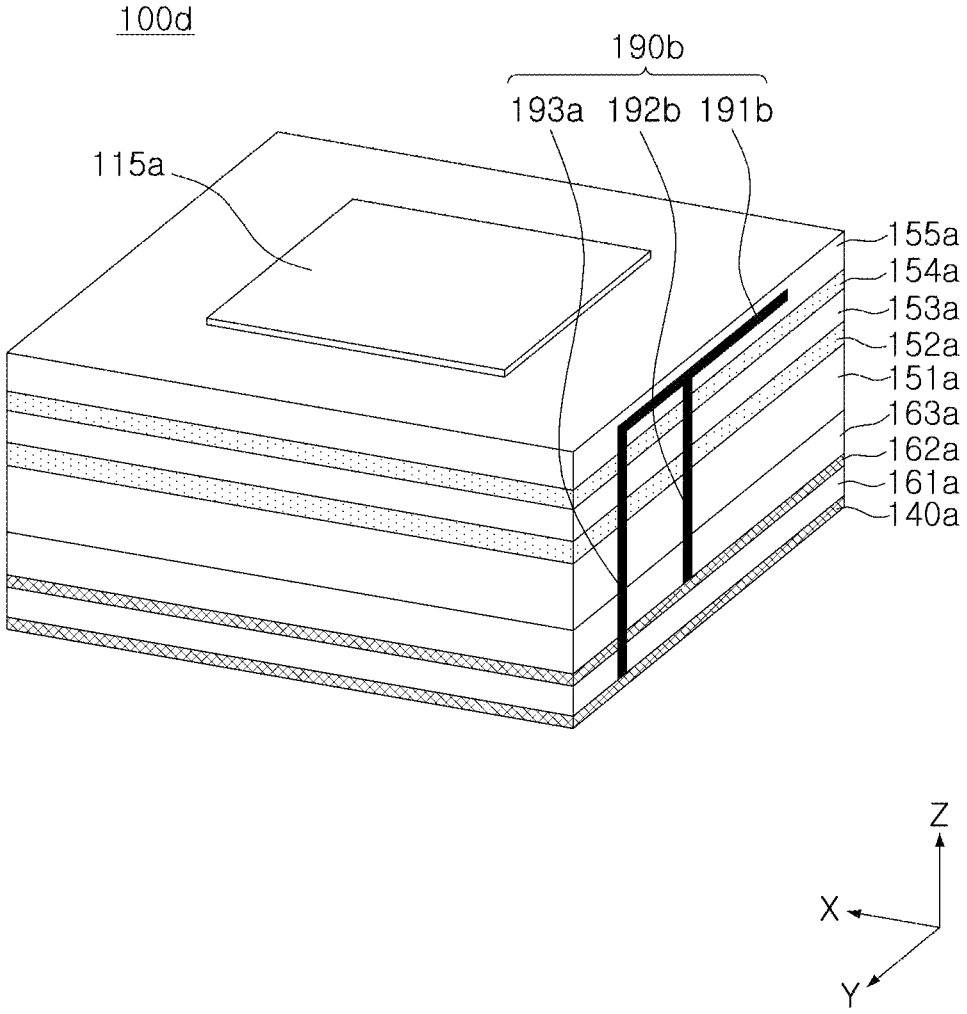

FIGS. 1C and 1D are side views illustrating a structure in which a side feed line and/or a side radiation pattern are additionally provided in at least one chip antenna module in a chip antenna module array, according to embodiments. FIG. 2B is a perspective view of at least one chip antenna module in a chip antenna module array, according to an embodiment.

Referring to FIG. 1C, at least one chip antenna module 100*c* of the chip antenna module array, according to an embodiment, may further include a side feed line 180*a* and a side radiation pattern 190*a*.

The side feed line 180*a* may be disposed between the ground pattern 125*a* and the first feed line dielectric layer 161*a*, and may be electrically connected through the first feed line dielectric layer 161*a* in a −Z direction. For example, the side feed line 180*a* may include a first side part 181*a* and a second side part 182*a*.

The side feed line 180*a* may be disposed between the first and third feed line dielectric layers 161*a* and 163*a*, and may be spaced apart from the chip-antenna feed line 170*a*.

The side radiation pattern 190*a* may be disposed to be closer to a horizontal side surface of the first patch antenna dielectric layer 151*a* than to the side feed line 180*a*, and may be electrically connected to the side feed line 180*a*.

For example, the side radiation pattern 190*a* may be configured to form a radiation pattern in a horizontal direction (for example, an X direction and/or a Y direction), similarly to a dipole antenna and a monopole antenna.

Accordingly, the chip antenna module 100*c* may not only form a radiation pattern in a vertical direction (for example, a Z direction) through the first patch antenna pattern 111*a* and/or the second patch antenna pattern 112*a*, but may also form a side radiation pattern in the horizontal direction through the side radiation pattern 190*a*.

For example, the side radiation pattern 190*a* may be configured to have a second resonant frequency (for example, 2 GHz, 3.5 GHz, 5 GHz, or 6 GHz) lower than a first resonant frequency (for example, 28 GHz, 39 GHz, or 60 GHz) of the first patch antenna pattern 111*a* and/or the second patch antenna pattern 112*a*.

Since a structure of the side radiation pattern 190*a* is different from a structure of the first patch antenna pattern 111*a* and/or the second patch antenna pattern 112*a*, the side radiation pattern 190*a* may have a second resonant frequency significantly lower than a frequency of the first patch antenna pattern 111*a* and/or the second patch antenna pattern 112*a*, depending on a configuration. Accordingly, the chip antenna module 100*c* may efficiently form a radiation pattern for first and second frequency bands even when there is a significant difference in frequency between the first and second frequency bands, respectively corresponding to the first and second resonant frequencies.

Referring to FIGS. 1D and 2B, at least one chip antenna module 100*d* in a chip antenna module array, according to an embodiment, may include a side radiation pattern 190*b*. At least a portion of the side radiation pattern 190*b* may be disposed on a side surface of the first patch antenna dielectric layer 151*a*, a side surface of the second patch antenna dielectric layer 152*a*, a side surface of the third patch antenna dielectric layer 153*a*, a side surface of the fourth patch antenna dielectric layer 154*a*, a side surface of the fifth patch antenna dielectric layer 155*a*, a side surface of the first feed line dielectric layer 161*a*, a side surface of the second feed line dielectric layer 162*a*, and/or a side surface of the third feed line dielectric layer 163*a*.

Accordingly, since the chip antenna module 100*d* may not provide a space, in which the side radiation pattern 190*b* is disposed, inside the chip antenna module 100*d*, a size of the chip antenna module 100*d* may be further reduced.

In addition, the chip antenna module 100*d* may include the side radiation pattern 190*b* formed in the vertical direction (for example, the Z direction) depending on a disposition of a side surface of the side radiation pattern 190*b*.

The side radiation pattern 190*b* may efficiently have a resonant frequency lower than the resonant frequency of the first patch antenna pattern 111*a* and/or the second patch antenna pattern 112*a*.

For example, the side radiation pattern 190*b* may be formed by a laser direct structuring (LDS) process, and may include a laser manufacturing antenna (LMA).

The first side part 181*b* and the second side part 182*b* of the side feed line 180*b* may be designed to be optimized for the side arrangement of the side radiation pattern 190*b*.

Referring to FIG. 2B, the side radiation pattern 190*b* may include a radiation portion 191*b*, a feeding portion 192*b*, and a ground portion 193*b*.

The side radiation pattern 190*b* may be electrically connected to the solder layer 140*a* through the ground portion 193*b*. The solder layer 140*a* may enter an electrically grounded state.

Thus, the side radiation pattern 190*b* may be more efficiently provided with a connection structure to grounding.

Figure 1E:
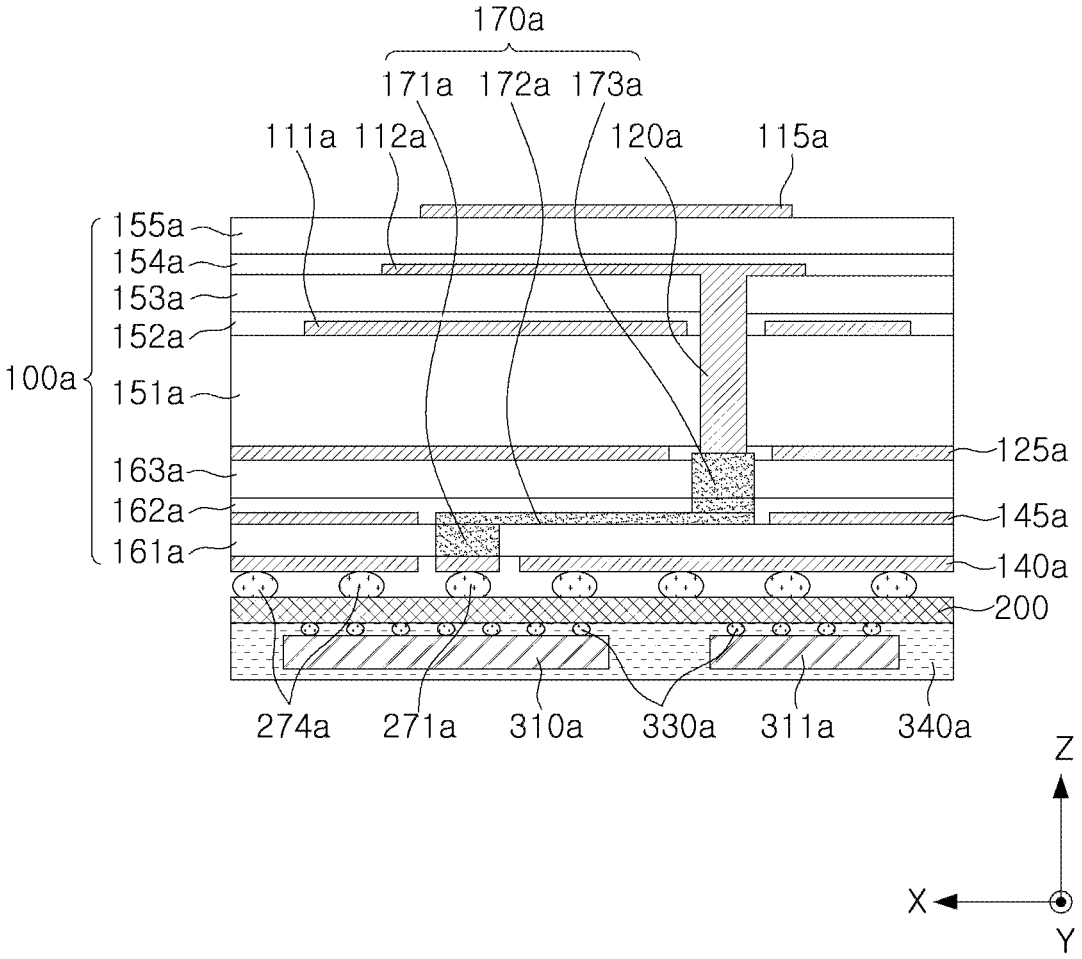
FIGS. 1E and 1F are side views illustrating a structure in which a chip antenna module in a chip antenna module array is mounted on an upper surface of a connection member, according to an embodiment.
Figure 1F:
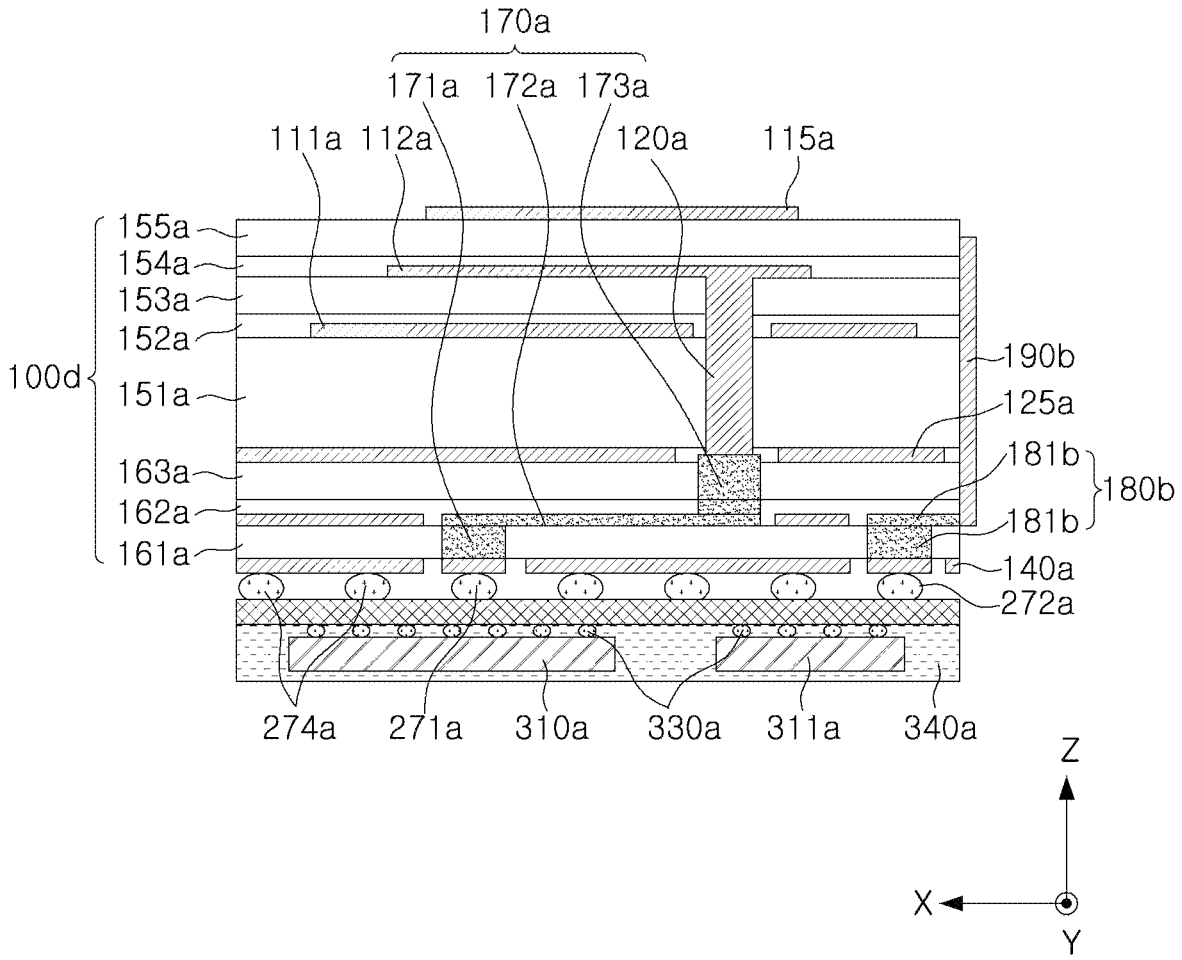

FIGS. 1E and 1F are side views illustrating a structure in which at least one chip antenna module in a chip antenna module array, according to an embodiment, is mounted on an upper surface of a connection member.

Referring to FIGS. 1E and 1F, an upper surface of a connection member 200 may provide a space for mounting chip antenna modules 100*a* through 100*d*, and a lower surface of the connection member 200 may form a space for mounting a first IC 310*a* and may form a space for mounting a second IC 311*a*, depending on a configuration.

The connection member 200 may include a connection member feed line to provide an electrical connection path between the chip antenna modules 100*a* through 100*d* and the first IC 310*a* and/or the second IC 311*a*.

For example, the connection member 200 may have a structure in which insulating layers and conductive layers are alternately laminated, and the connection member feed line may be disposed on the conductive layers.

A size and/or an electrical connection method (for example, a ball grid array method or a high-density interface (HDI) method) of the connection member 200 may be determined based on complexity of the connection member feed line in the connection member 200.

As the number of chip antenna modules, mounted on the upper surface of the connection member 200, is increased, an overall gain and/or linearity of RF signal transmission and reception may be increased, the size of the connection member 200 may be further increased, and the degree of freedom in the electrical connection method of the connection member 200 may be reduced.

Since at least one chip antenna module 100*a* or 100*d* in a chip antenna module array according to an embodiment may include a chip-antenna feed line 170*a*, complexity of the connection member feed line in the connection member 200 may be reduced.

In addition, since at least one chip antenna module 100*d* of a chip antenna module array, according to an embodiment, may include a side feed line 180*b* and the side radiation pattern 190*b*, the connection member 200 may not include a side antenna. Therefore, the complexity of the connection member feed line in the connection member 200 may be reduced.

Accordingly, a size of the connection member 200 may be further reduced, and the degree of freedom in the electrical connection method of the connection member 200 may be further increased.

Referring to FIGS. 1E and 1F, the chip antenna module array, according to an embodiment, may further include at least one each of electrical connection structures 271*a*, 272*a*, and 274*a*, at least one IC electrical connection structure 330*a*, and at least one encapsulant 340*a*.

The electrical connection structures 271*a*, 272*a*, and 274*a* may electrically connect the connection member 200 to the chip antenna module 100*a* or 100*d*, and may be configured to have a melting point lower than a melting point of the chip-antenna feed line 170*a* for mounting. For example, each of the electrical connection structures 271*a*, 272*a*, and 274*a* may be one of a solder ball, a pin, a land, and a pad.

The IC electrical connection structure 330*a* may electrically connect the connection member 200 and the first IC 310*a* and/or the second IC 311*a* to each other, and may have a shape, a structure, and/or a material similar to those of the electrical connection structures 271*a*, 272*a*, and 274*a*.

The encapsulant 340*a* may encapsulate at least a portion of the first IC 310*a* and/or the second IC 311*a*, and may physically protect the first IC 310*a* and/or the second IC 311*a* to one another. For example, the encapsulant 340*a* may be formed of a photoimageable encapsulant (PIE), an Ajinomoto Build-up Film (ABF), an epoxy molding compound (EMC), or the like.

Figure 3A:
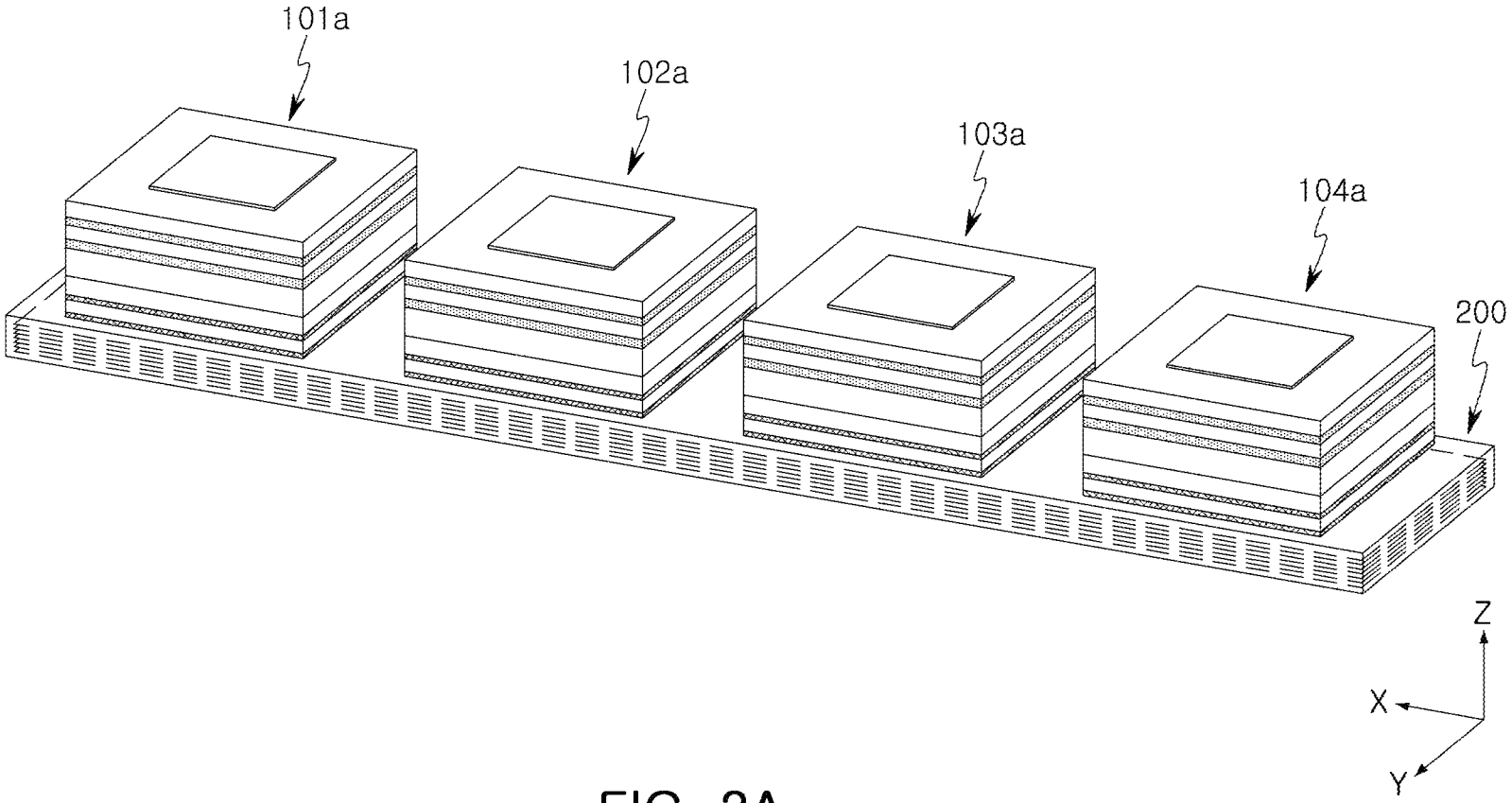
FIGS. 3A and 3B are perspective views of a chip antenna module array, according to an embodiment.
Figure 3B:
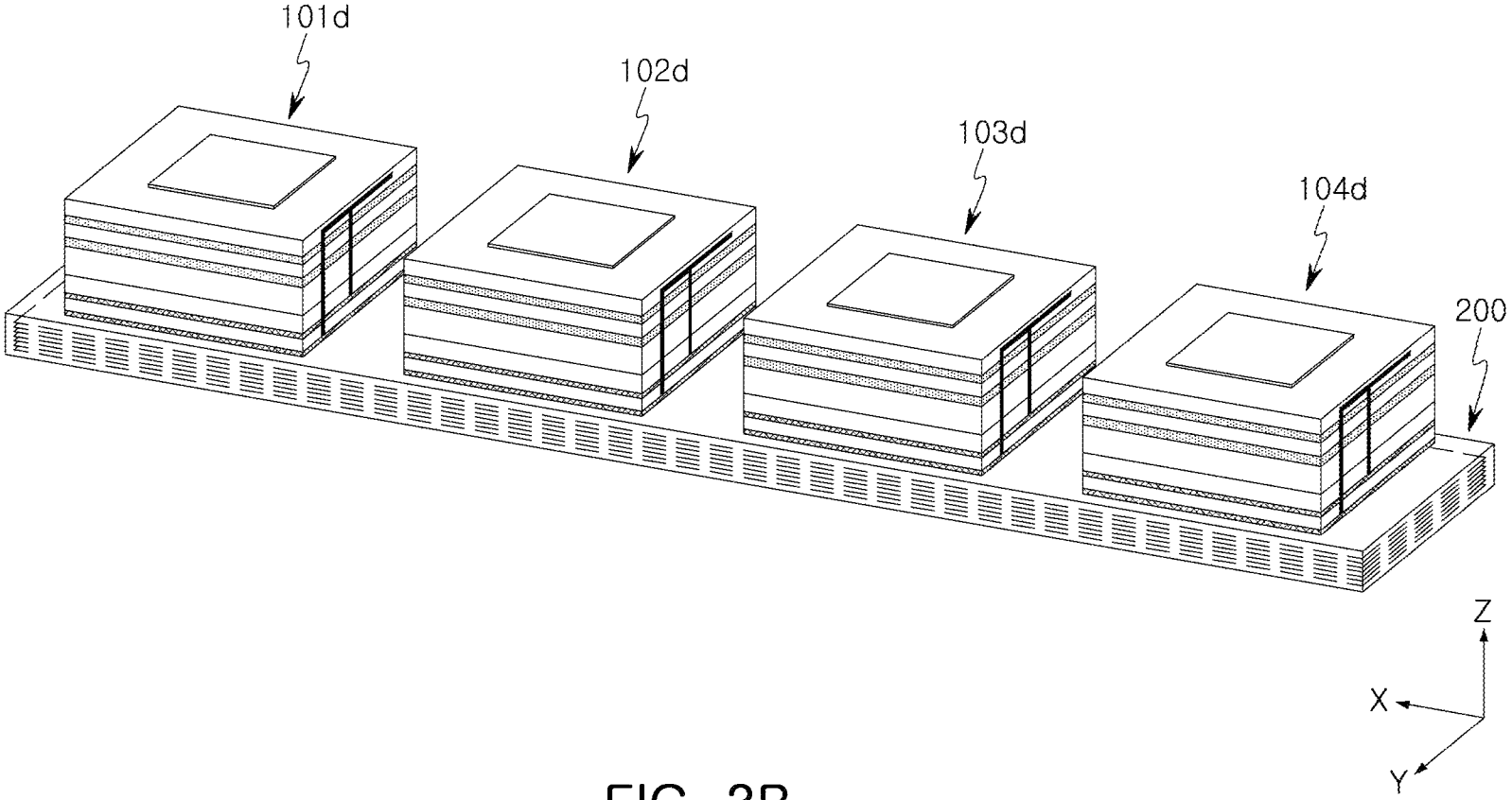

FIGS. 3A and 3B are perspective views of a chip antenna module array, according to an embodiment.

Referring to FIG. 3A, chip antenna modules 101*a*, 102*a*, 103*a*, and 104*a*, each not including a side radiation pattern, may be arranged side-by-side on an upper surface of a connection member 200 in an X direction. The chip antenna modules 101*a*, 102*a*, 103*a*, and 104*a* may each have a configuration corresponding to that of the chip antenna module 100*a* described above.

Referring to FIG. 3B, chip antenna modules 101*d*, 102*d*, 103*d*, and 104*d*, each including a side radiation pattern, may be arranged side-by-side on an upper surface of a connection member 200 in an X direction. The chip antenna modules 101*d*, 102*d*, 103*d*, and 104*d* may each have a configuration corresponding to that of the chip antenna module 100*d* described above.

FIGS. 4A to 4F sequentially illustrate plan views, in a –Z direction, depending on locations, in a Z direction, of at least one chip antenna module in a chip antenna module array, according to an embodiment.

Figure 4A:
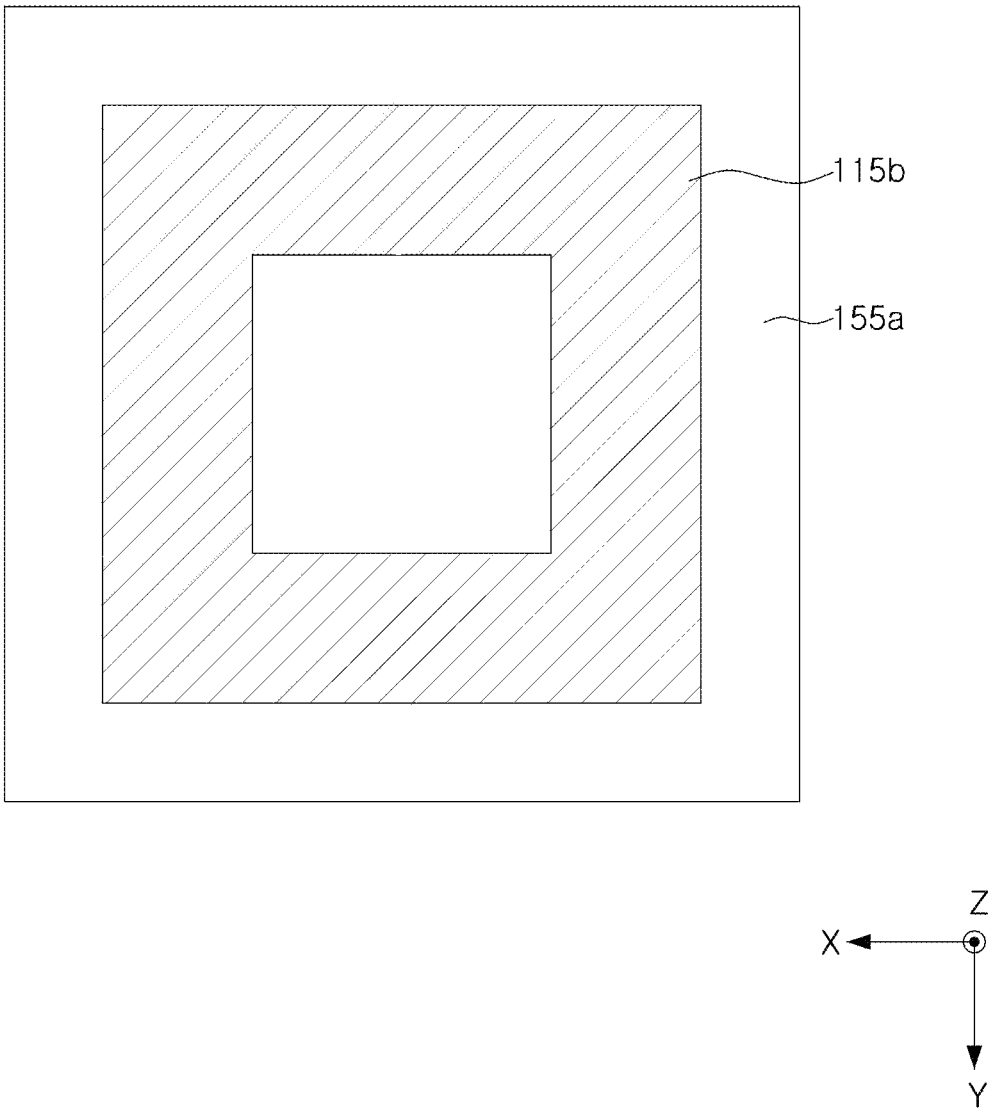
FIGS. 4A to 4F sequentially illustrate plan views in a −Z direction, depending on locations, in a Z direction, of a chip antenna module in a chip antenna module array, according to embodiments.

Referring to FIG. 4A, the third patch antenna pattern 115*b* may be disposed on the upper surface of the fifth patch antenna dielectric layer 155*a* and may have a slot.

Figure 4B:
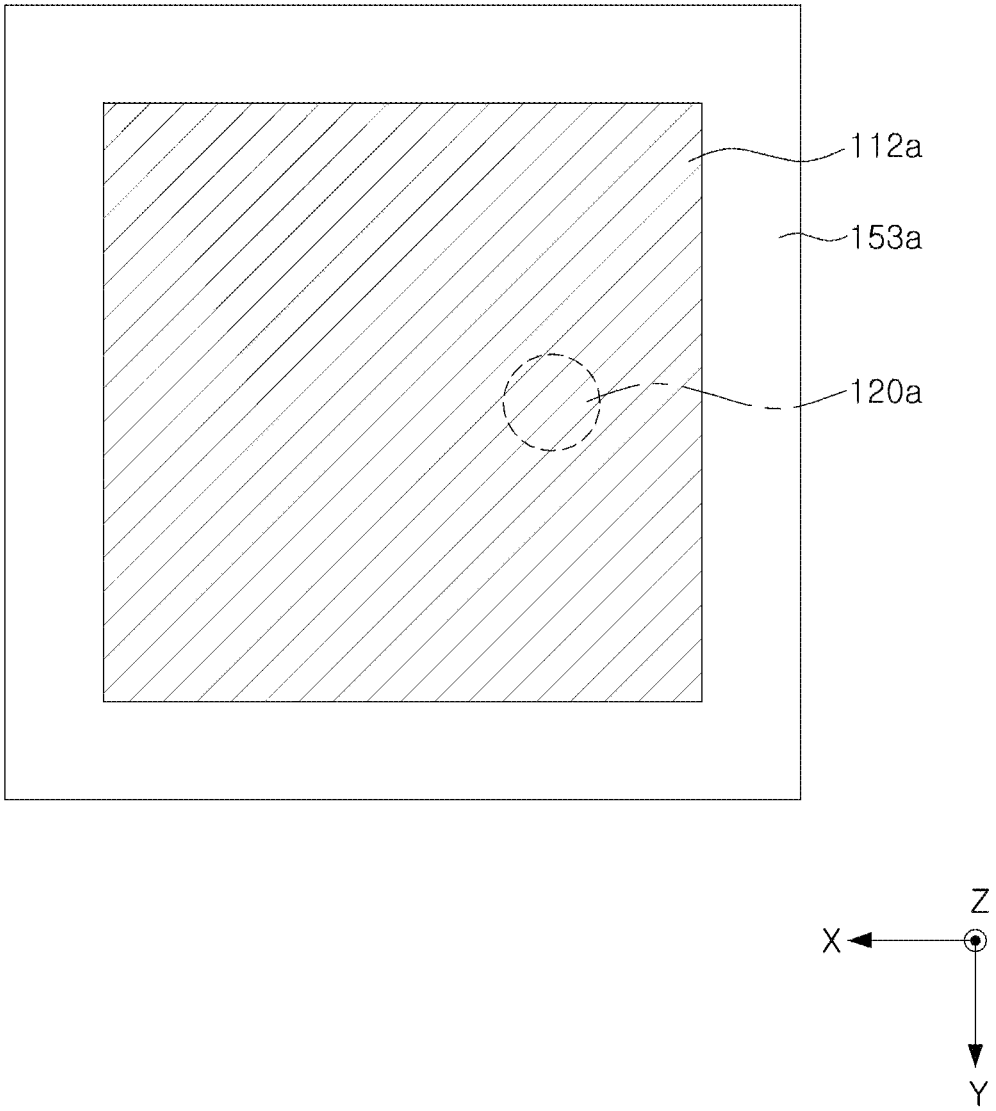

Referring to FIG. 4B, the second patch antenna pattern 112*a* may be disposed on the upper surface of the third patch antenna dielectric layer 153*a* and may include a connection point of the feed via 120*a*.

Figure 4C:
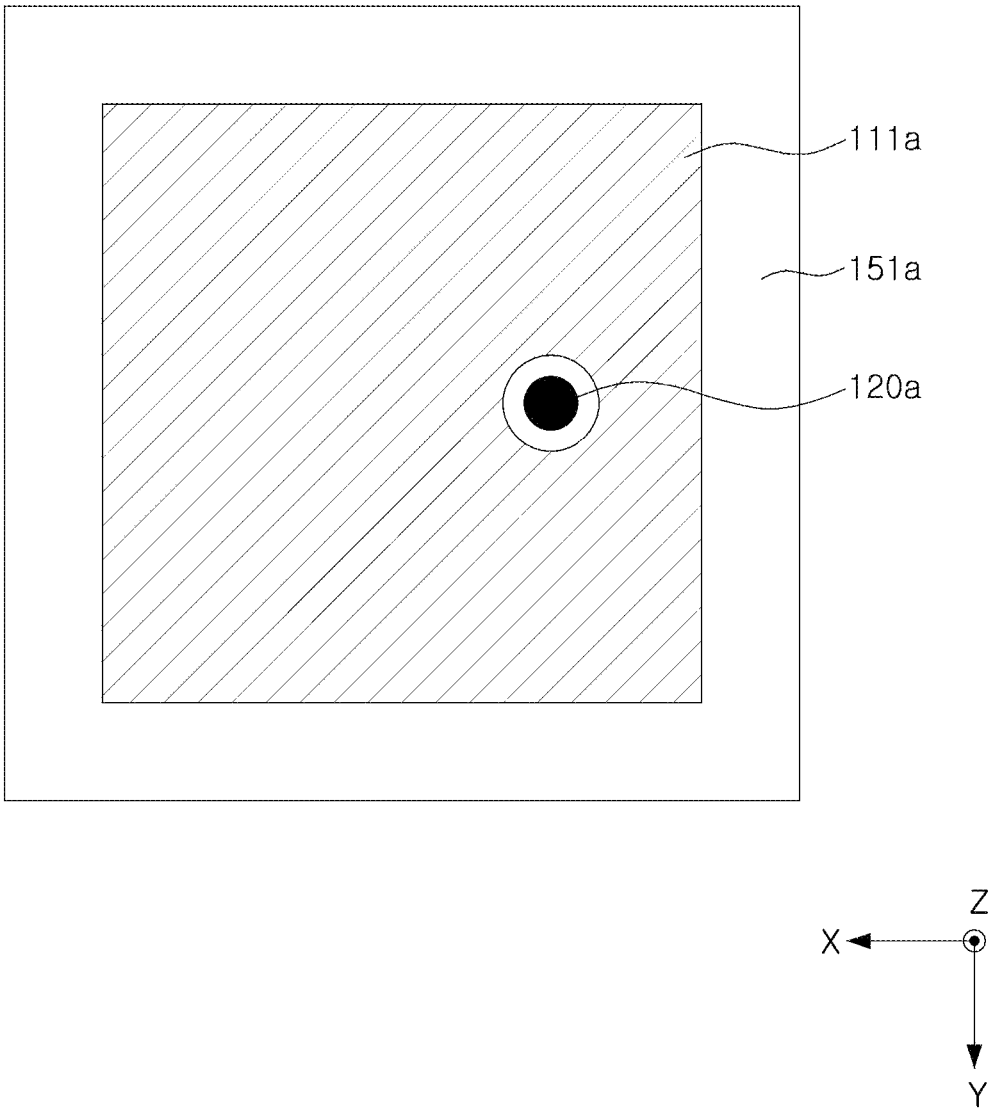

Referring to FIG. 4C, the first patch antenna pattern 111*a* may be disposed on the upper surface of the first patch antenna dielectric layer 151*a*, and may have a through-hole through which the feed via 120*a* penetrates.

Figure 4D:
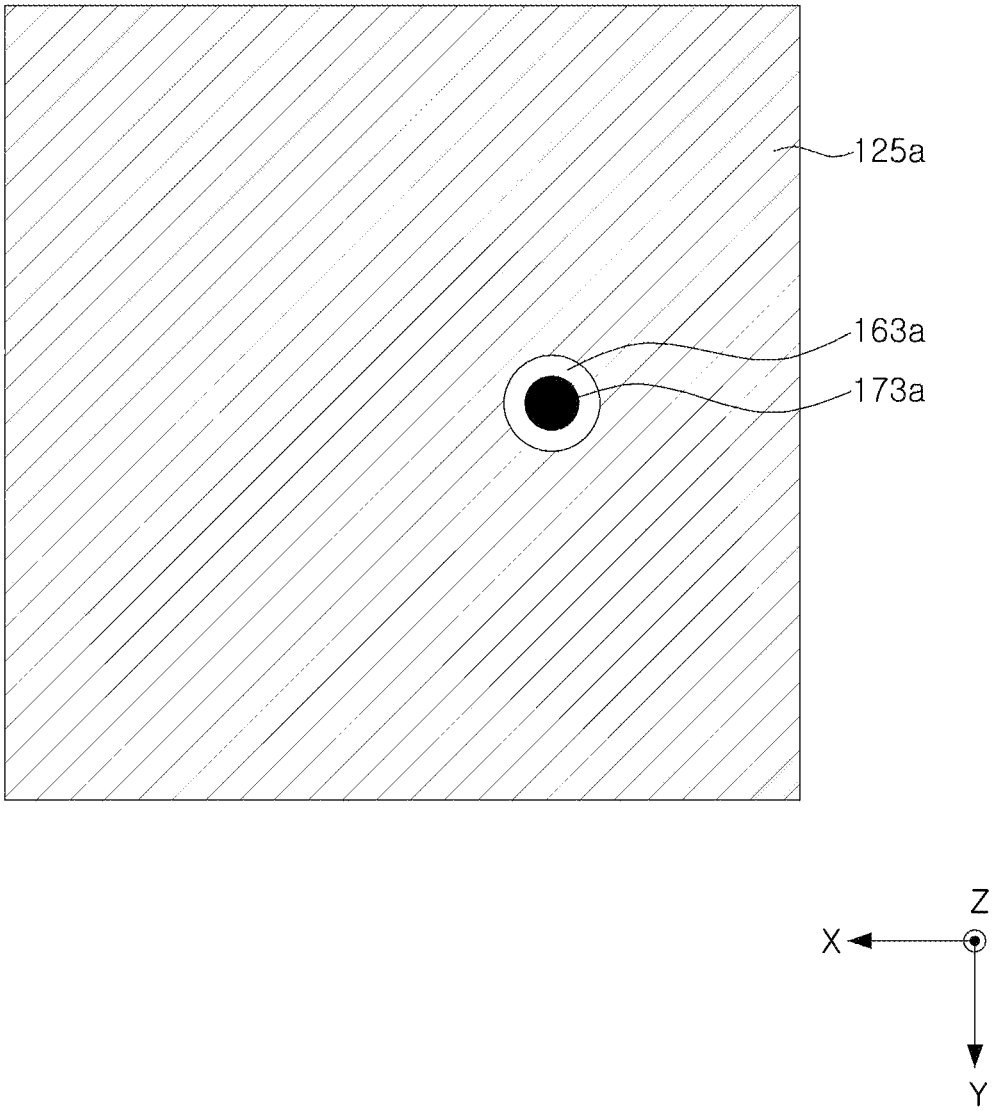

Referring to FIG. 4D, the ground pattern 125*a* may be disposed on the upper surface of the third feed line dielectric layer 163*a*, and may have a through-hole overlapping the third part 173*a* of the chip-antenna feed line 170*a* in a vertical direction (for example, a Z direction).

Figure 4E:
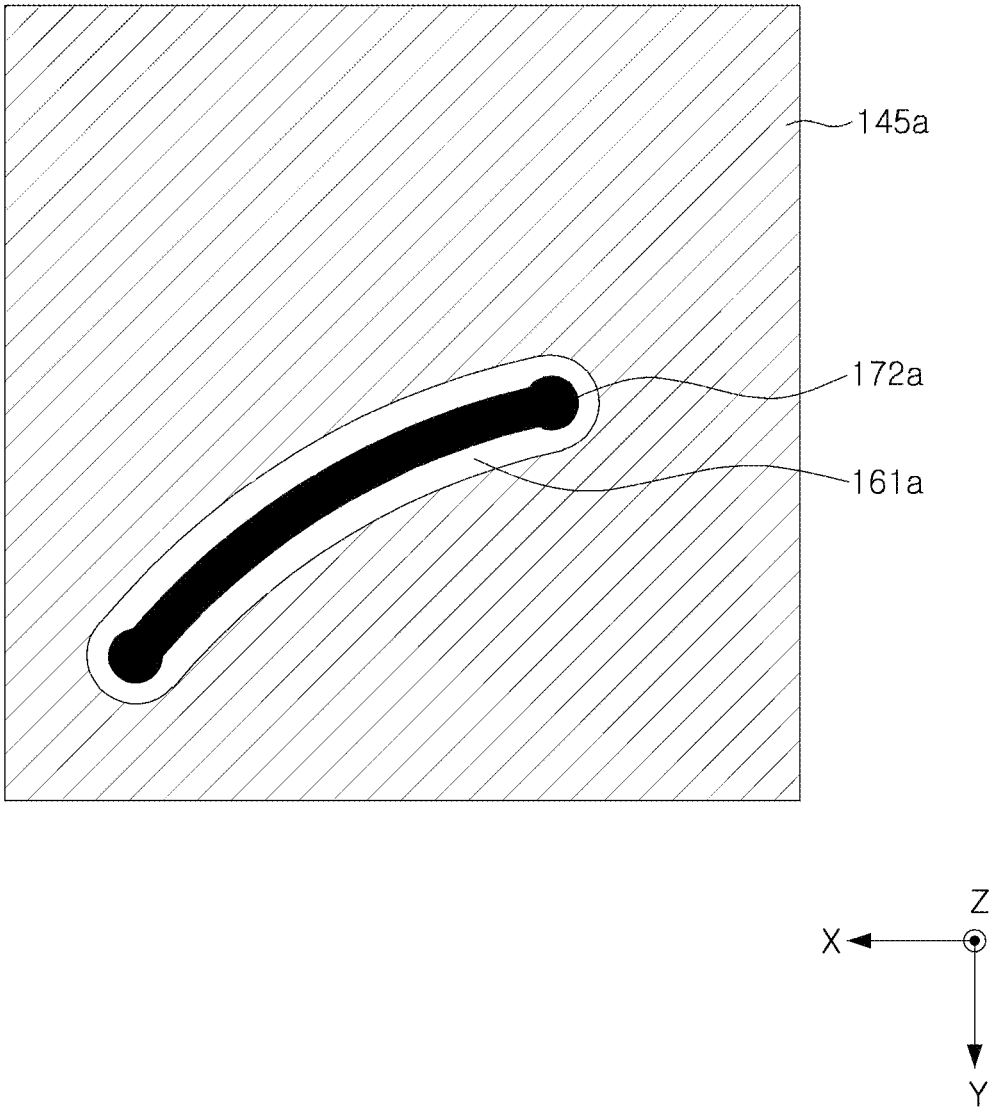

Referring to FIG. 4E, the second part 172*a* of the chip-antenna feed line 170*a* may be disposed on the upper surface of the first feed line dielectric layer 161*a*, and the feed line surrounding pattern 145*a* may be configured to surround the second part 172*a* of a chip-antenna feed line 170*a*.

Figure 4F:
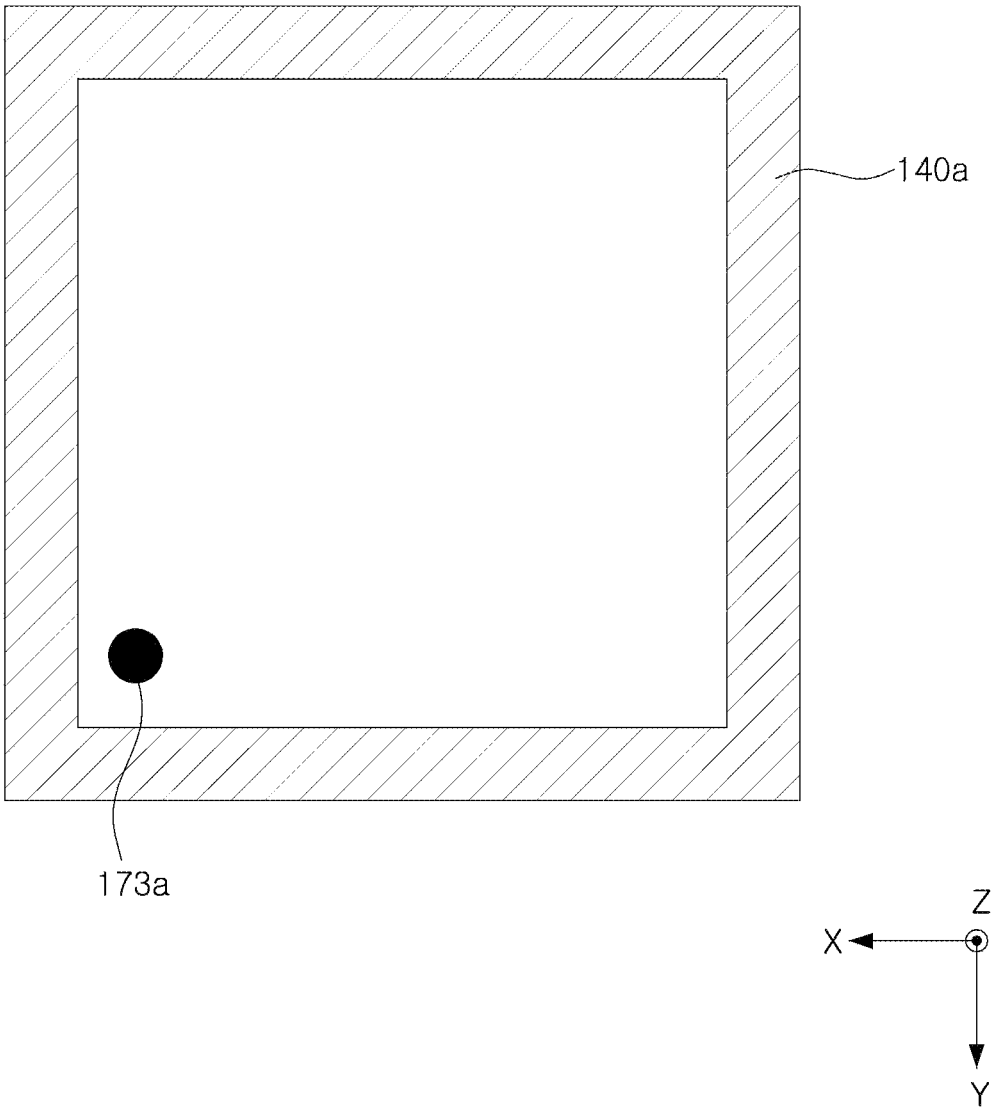

Referring to FIG. 4F, the solder layer 140*a* may be configured in a ring shape disposed along a side surface of a chip antenna module, and the third part 173*a* of a chip-antenna feed line 170*a* may be surrounded by the solder layer 140*a*.

Figure 5A:
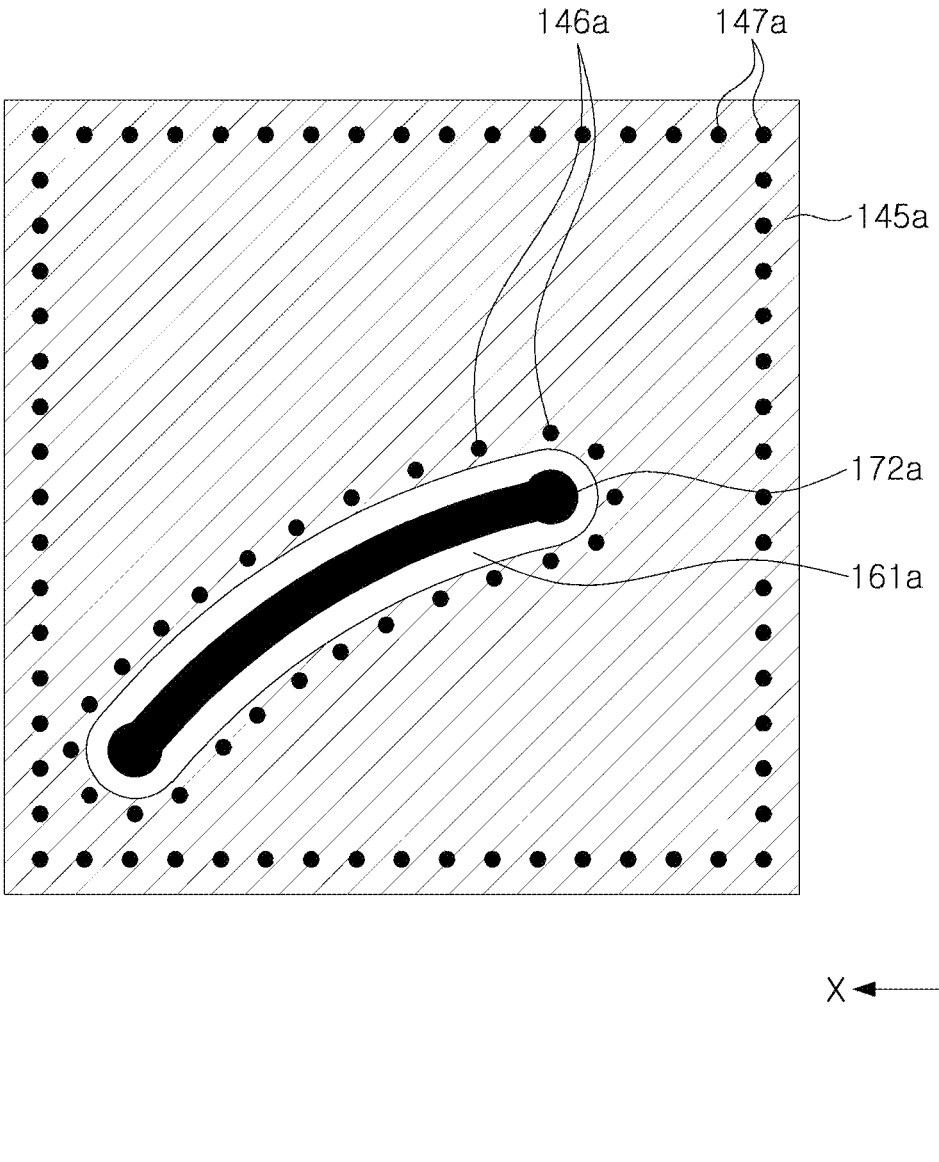
FIGS. 5A to 5C are plan views illustrating a modified structure around a chip-antenna feed line in a chip antenna module in a chip antenna module array, according to embodiments.
Figure 5B:
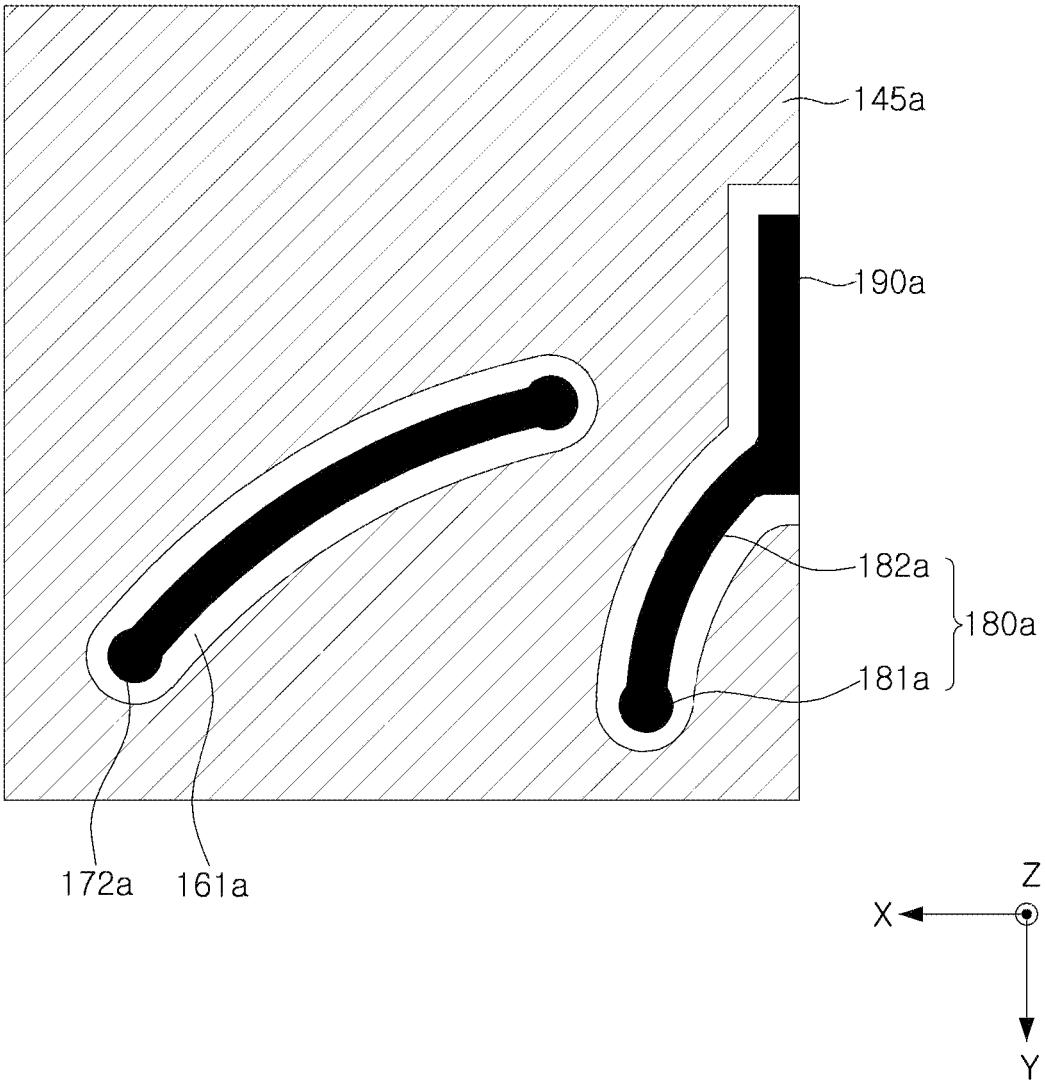
Figure 5C:
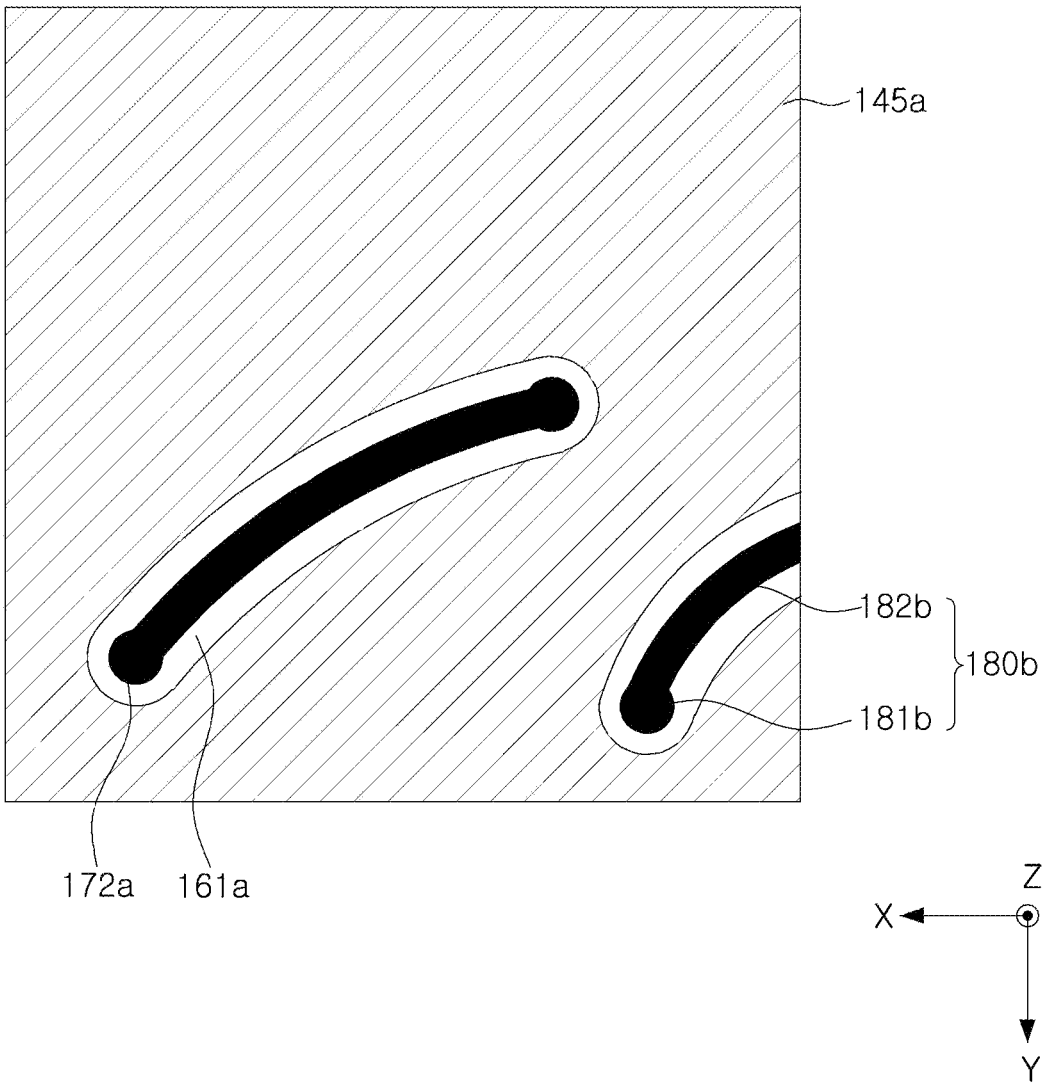

FIGS. 5A to 5C are plan views illustrating a modified structure around a chip-antenna feed line in at least one chip antenna module in a chip antenna module array, according to embodiments.

Referring to FIG. 5A, a chip antenna module may include feed line surrounding vias 146*a* arranged to electrically connect each feed line surrounding pattern 145*a* and the ground pattern 125*a* to each other and to surround the second part 172*a* of the chip-antenna feed line 170*a*.

Accordingly, an influence of external electromagnetic noise on an RF signal transmitted through the second part 172*a* of the chip-antenna feed line 170*a* may be further reduced.

Additionally, feed line surrounding vias 147*a* may be arranged along an external periphery of the feed line surrounding pattern 145*a* to surround the second part 172*a* of the chip-antenna feed line 170*a*.

Referring to FIG. 5B, the second part 172*a* of the chip-antenna feed line 170*a* and the side feed line 180*a* may be spaced apart from each other, and the feed line surrounding pattern 145*a* may surround each of the second part 172*a* and the side feed line 180*a*.

The feed line surrounding pattern 145*a* may surround the side radiation pattern 190*a* and the side feed line 180*a*.

Referring to FIG. 5C, a side feed line 180*b* may be exposed through a side surface of a chip antenna module to be connected to a side radiation pattern disposed on a side surface of a chip antenna module.

Figure 6A:
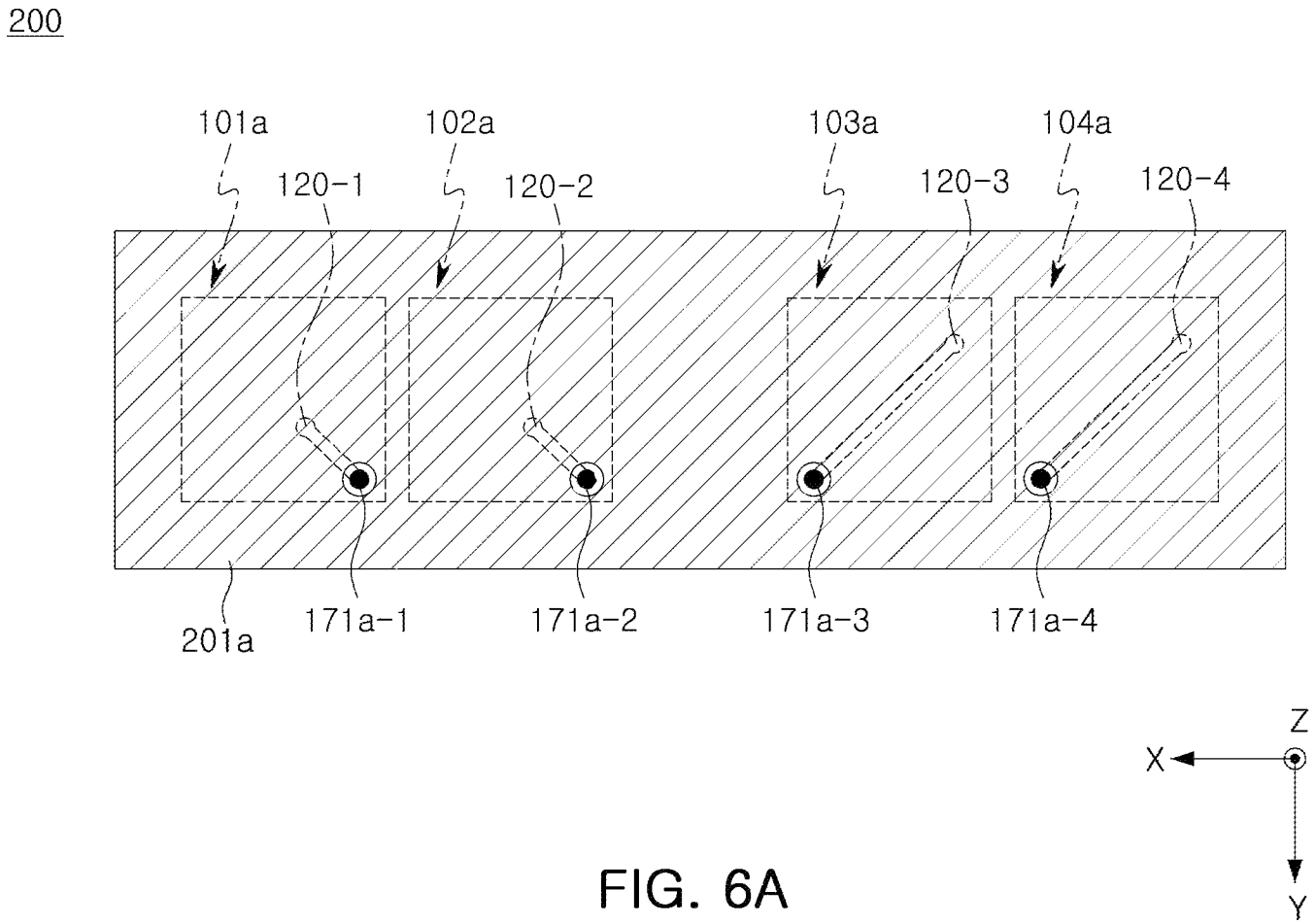
FIGS. 6A and 6B sequentially illustrate plan views, in a −Z direction, depending on locations, in a −Z direction, of a connection member included in a chip antenna module array, according to embodiments.
Figure 6B:
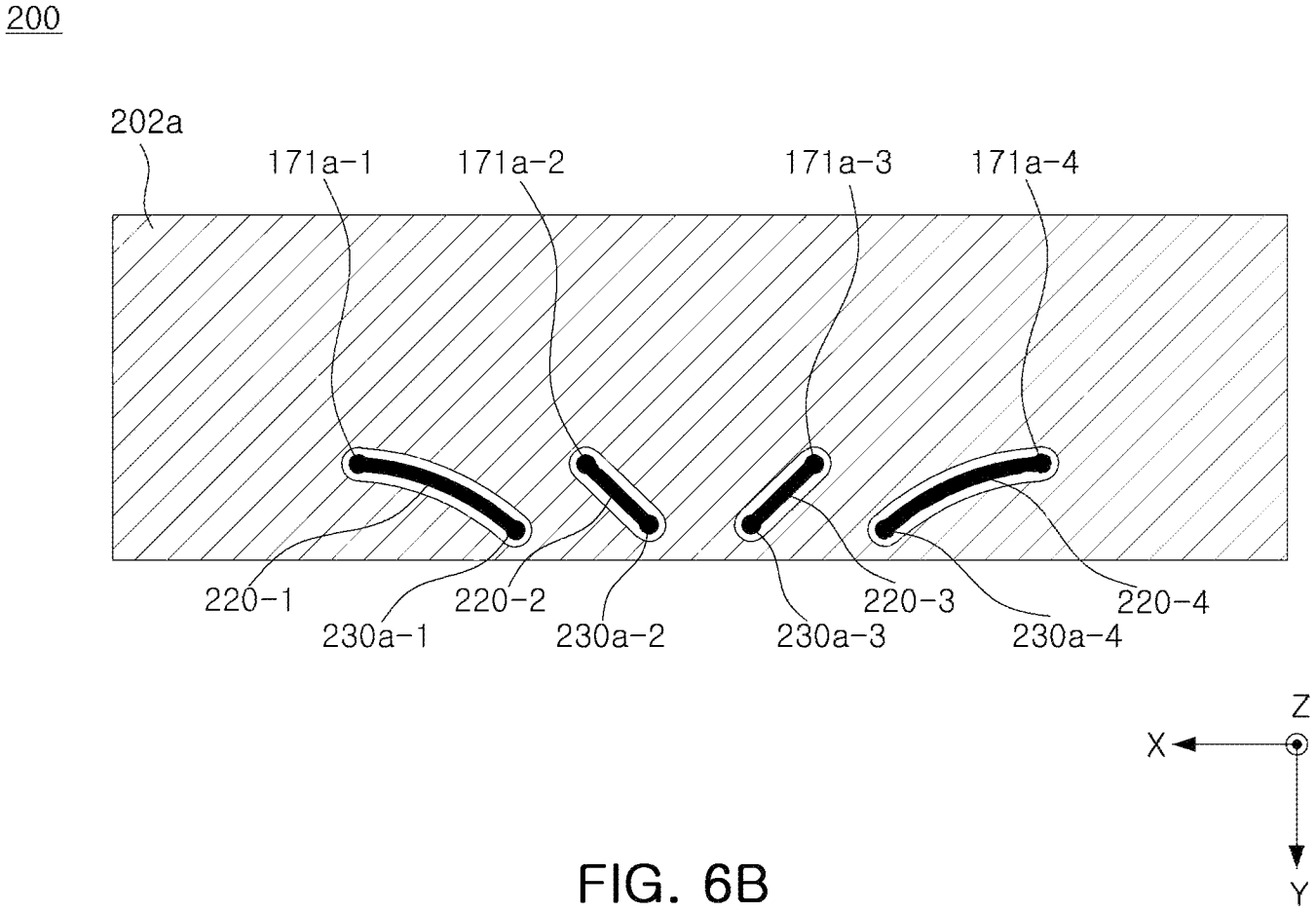

FIGS. 6A and 6B sequentially illustrate plan views in a –Z direction, depending on a location, in a Z direction, of a connection member included in a chip antenna module array, according to an embodiment.

Referring to FIG. 6A, the connection member 200 may include a first ground plane 201*a*. The first ground plane 201*a* may have through-holes for providing paths of connection to integrated circuits (ICs) of first parts 171*a*-1, 171*a*-2, 171*a*-3, and 171*a*-4 of chip-antenna feed lines.

The first parts 171*a*-1, 171*a*-2, 171*a*-3, and 171*a*-4 of the chip-antenna feed lines may be electrically connected to feed vias 120-1, 120-2, 120-3, and 120-4, respectively. The first parts 171*a*-1, 171*a*-2, 171*a*-3, and 171*a*-4 may be disposed in a space, in which the chip antenna modules 101*a*, 102*a*, 103*a*, and 104*a* are disposed, in the XY plane.

Referring to FIG. 6B, the connection member 200 may include a second ground plane 202*a*. The second ground plane 202*a* may surround each of connection member feed lines 220-1, 220-2, 220-3, and 220-4.

The connection member feed lines 220-1, 220-2, 220-3, and 220-4 may extend in a horizontal direction (for example, an X direction and/or a Y direction) such that chip-antenna feed lines and wiring vias 230*a*-1, 230*a*-2, 230*a*-3, and 230*a*-4 are electrically connected to each other, respectively.

The wiring vias 230*a*-1, 230*a*-2, 230*a*-3, and 230*a*-4 may extend in the vertical direction (for example, the Z direction) to be electrically connected to the IC.

Depending on a configuration, a feed via of a chip antenna module close to a center of the connection member 200, among the chip antenna modules 101*a*, 102*a*, 103*a*, and 104*a*, may be connected to wiring vias 230*a*-1, 230*a*-2, 230*a*-3, and 230*a*-4 without connection to the connection member feed line.

Figure 7A:
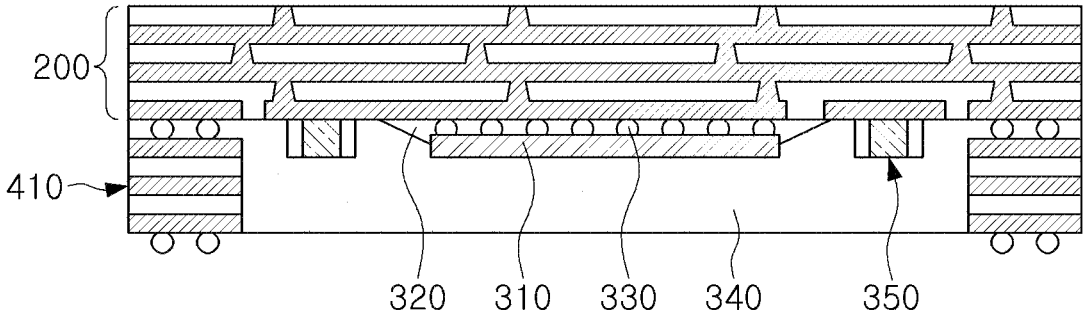
FIGS. 7A and 7B are side views illustrating structures of a portion below a connection member included in a chip antenna module array, according to embodiments.
Figure 7B:
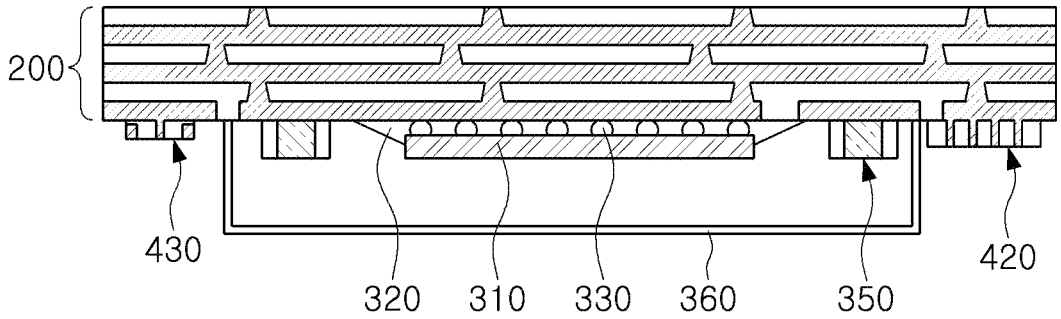

FIGS. 7A and 7B are side views illustrating structures of a portion below a connection member included in a chip antenna module array, according to embodiments.

Referring to FIG. 7A, a chip antenna module, according to an embodiment, may include at least a portion of the connection member 200, an IC 310, an adhesive member 320, an electrical connection structure 330, an encapsulant 340, a passive component 350, and a core member 410.

The IC 310 may be the same as the first IC 310*a* and/or the second IC 311*a* described above with reference to FIGS. 1E and 1F, and may be disposed below the connection member 200. The IC 310 may be electrically connected to a connection member feed line to transmit or receive an RF signal, and may be electrically connected to a ground plane of the connection member 200 to receive grounding. For example, the IC 310 may generate a signal converted by performing at least a portion of frequency conversion, amplification, filtering, phase control, and power generation.

The adhesive member 320 may include an adhesive material enabling the IC 310 and the connection member 200 to adhere to each other.

The electrical connection structure 330 may be the same as the IC electrical connection structure 330*a* described above with reference to FIGS. 1E and 1F. The encapsulant 340 is the same as the encapsulant described above with reference to FIGS. 1E and 1F.

The passive component 350 may be disposed on a lower surface of the connection member 200, and may be electrically connected to a wiring and/or a ground plane of the connection member 200 through the electrical connection structure 330. For example, the passive component 350 may include at least at a portion of a capacitor (for example, a multilayer ceramic capacitor (MLCC)), an inductor, and a chip resistor.

The core member 410 may be disposed on a lower side of the connection member 200, and may be electrically connected to the connection member 200 to receive an intermediate frequency (IF) signal or a baseband signal from an external entity and transmit the received IF or baseband signal to the IC 310, or to receive the IF signal or the baseband signal from the IC 310 and transmit the received IF or baseband signal to an external entity. A frequency of the RF signal (for example, 24 GHz, 28 GHz, 36 GHz, 39 GHz, or 60 GHz) is higher than a frequency of the IF signal (for example, 2 GHz, 5 GHz, 10 GHz, or the like).

For example, the core member 410 may transmit or receive the IF signal or the baseband signal to or from the IC 310 through a wiring which may be included in the IC ground plane of the connection member 200.

Referring to FIG. 7B, a chip antenna module, according to an embodiment, may include at least a portion of a shielding member 360, a connector 420, and a chip end-fire antenna 430.

The shielding member 360 may be disposed below the connection member 200, and may be disposed to confine the IC 310 together with the connection member 200. For example, the shielding member 360 may be disposed to cover (for example, conformally shield) the IC 310 and the passive component 350 together, or may be disposed to individually cover (for example, compartmentally shield) each of the IC 310 and the passive component 350. For example, the shielding member 360 may have a hexahedral shape of which one side is open, and may form a hexahedral accommodation space through coupling to the connection member 200. The shielding member 360 may be formed of a material having high conductivity such as copper to have a short skin depth, and may be electrically connected to a ground plane of the connection member 200. Thus, the shielding member 360 may reduce electromagnetic noise that the IC 310 and the passive component 350 may receive.

The connector 420 may have a connection structure of a cable (for example, a coaxial cable or a flexible PCB), may be electrically connected to an IC ground plane of the connection member 200, and may have a function similar to the function of the core member 410 described above. For example, the connector 420 may receive an IF signal, a baseband signal, and/or power from a cable, or may provide the IF signal and/or the baseband signal to the cable.

The chip end-fire antenna 430 may transmit or receive an RF signal in support of the chip antenna module. For example, the chip end-fire antenna 430 may include a dielectric block having a dielectric constant greater than a dielectric constant of an insulating layer, and electrodes respectively disposed on both sides of the dielectric block. One of the electrodes may be electrically connected to a wiring of the connection member 200, and another of the electrodes may be electrically connected to a ground plane of the connection member 200.

Figure 8A:
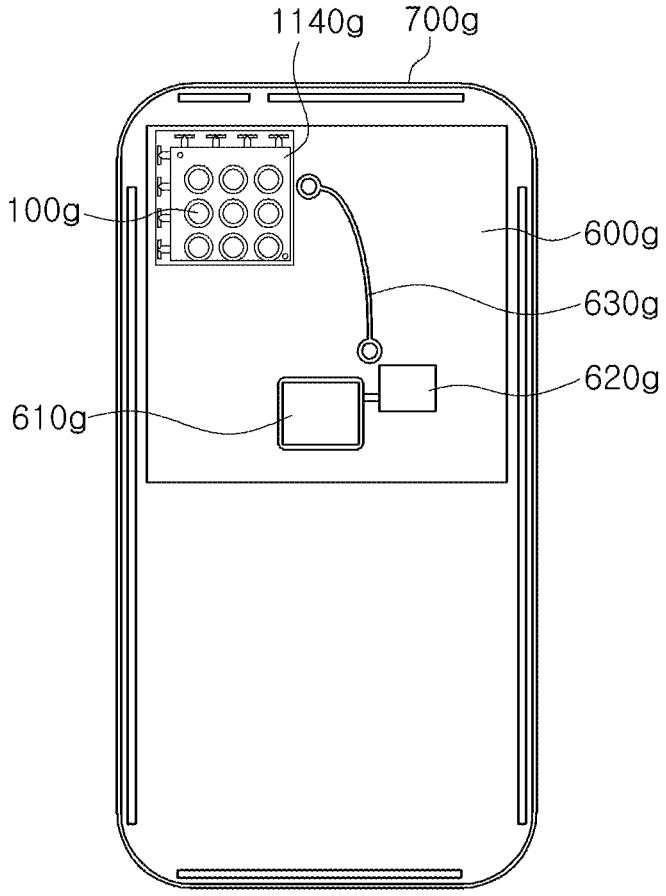
FIGS. 8A and 8B are plan views illustrating electronic devices including chip antenna modules, according to embodiments.
Figure 8B:
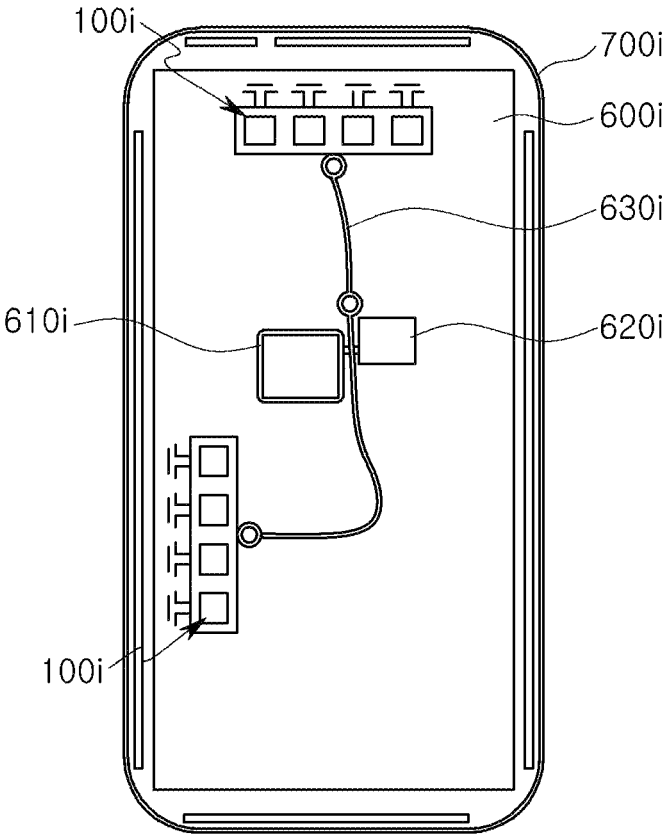

FIGS. 8A and 8B are plan views illustrating electronic devices including chip antenna modules, according to embodiments.

Referring to FIG. 8A, a chip antenna module array including a chip antenna module 100*g* may be disposed adjacent to a side boundary of the electronic device 700*g* on a set substrate 600*g* of the electronic device 700*g*.

The electronic device 700*g* may be a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like, but is not limited to the foregoing examples.

A communications module 610*g* and a baseband circuit 620*g* may also be disposed on the set substrate 600*g*. The chip antenna module array may be electrically connected to the communications module 610*g* and/or the baseband circuit 620*g* through a coaxial cable 630*g*.

The communications module 610*g* may include one or more among: a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphics processor (for example, a graphics processing unit (GPU)), a digital signal processor, a cryptographic processor, a microprocessor, a microcontroller, or the like; and a logic chip such as an analog-to-digital converter (ADC), an application-specific integrated circuit (ASIC), or the like to perform digital signal processing.

The baseband circuit 620*g* may generate a base signal by performing analog-to-digital conversion, amplification for an analog signal, filtering, and frequency conversion. The base signal, which is input and output from the baseband circuit 620*g*, may be transmitted to a chip antenna module through a cable.

For example, the base signal may be transmitted to an IC through an electrical connection structure, a core via, and a wiring. The IC may convert the base signal into an RF signal in a millimeter wave (mmWave) band.

Referring to FIG. 8B, chip antenna module arrays, each including a chip antenna module 100*i*, may be disposed adjacent to the center of respective sides of a polygonal electronic device 700*i* on a set substrate 600*i* of the electronic device 700*i*. A communications module 610*i* and a baseband circuit 620*i* may be further disposed on the set substrate 600*i*. The plurality of chip antenna module arrays may be electrically connected to the communications module 610*i* and/or the baseband circuit 620*i* through a coaxial cable 630*i*.

Referring to FIGS. 8A and 8B, a dielectric layer 1140*g* may fill at least a portion of a space between chip antenna modules included in a chip antenna module array, according to an embodiment.

The dielectric layers disclosed herein may be formed of an FR4, a liquid crystal polymer (LCP), a low temperature co-fired ceramic (LTCC), a thermosetting resin such as an epoxy resin, a thermoplastic resin such as a polyimide resin, a resin in which the thermosetting resin or the thermoplastic resin is mixed with an inorganic filler or is impregnated together with an inorganic filler in a core material such as a glass fiber (or a glass cloth or a glass fabric), for example, prepreg, ABF, FR-4, BT, or the like, a photoimageable dielectric (PID) resin, a copper clad laminate (CCL), a glass or ceramic-based insulating material, or the like.

The patterns, the vias, the planes, the strips, the lines, and the electrical connection structures disclosed herein may include a metal material (for example, copper (Cu), aluminum (Al), silver (Ag), tin (Sn), gold (Au), nickel (Ni), lead (Pb), titanium (Ti), alloys thereof, or the like), and may be formed using a plating method such as chemical vapor deposition (CVD), physical vapor deposition (PVD), sputtering, subtractive, additive, a semi-additive process (SAP), a modified semi-additive process (MSAP), or the like, but are not limited to the foregoing materials and formation methods.

The RF signals disclosed herein may include protocols such as wireless fidelity (Wi-Fi) (Institute of Electrical and Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+ (HSPA+), high speed downlink packet access+ (HSDPA+), high speed uplink packet access+ (HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth®, 3G, 4G, and 5G protocols, and any other wireless and wired protocols, designated after the abovementioned protocols, but are not limited to these example protocols.

As described above, since a chip antenna module array may reduce feed line complexity caused by integration of a plurality of feed lines of a plurality of chip antenna modules, a size of a connection member, on which the plurality of chip antenna modules are mounted, may be reduced or the degree of freedom in an electrical connection method of the connection member may be increased while providing complete antenna performance (for example, a gain, a bandwidth, linearity, and the like) of the plurality of chip antenna modules.

In addition, a chip antenna module array and a chip antenna module, according embodiments disclosed herein, may efficiently reduce transmission loss of a feed line or enhance side radiation pattern formation efficiency while providing complete antenna performance (for example, a gain, a bandwidth, linearity, and the like)

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module array, comprising:

a connection member comprising:

wiring vias spaced apart from each other and extending in a vertical direction; and at least one connection member feed line electrically connected to a corresponding wiring via among the wiring vias, and extending in a horizontal direction; and chip antenna modules spaced apart from each other and mounted on an upper surface of the connection member, wherein each of the chip antenna modules comprises:

a first patch antenna dielectric layer;

a feed via extending through the first patch antenna dielectric layer; and a patch antenna pattern disposed on an upper surface of the first patch antenna dielectric layer and configured to be fed from the feed via, and wherein at least one of the chip antenna modules comprises:

a ground pattern disposed on a lower surface of the first patch antenna dielectric layer;

a chip-antenna feed line including first, second, and third parts connected to each other in series, disposed such that the second part is disposed on a lower surface of the ground pattern, and electrically connecting the at least one connection member feed line and the feed via to each other;

a first feed line dielectric layer disposed on a lower surface of the second part; and a solder layer disposed on a lower surface of the first feed line dielectric layer and configured to support mounting of at least one of the chip antenna modules.

2. The chip antenna module array of claim 1, wherein the at least one of the chip antenna modules further comprises:

a third feed line dielectric layer disposed between the ground pattern and the first feed line dielectric layer; and a second feed line dielectric layer disposed between the first and third feed line dielectric layers, and disposed in contact with at least a portion of the chip-antenna feed line.

3. The chip antenna module array of claim 2, wherein the second feed line dielectric layer has a dielectric constant less than a dielectric constant of each of the first and third feed line dielectric layers.

4. The chip antenna module array of claim 2, wherein the at least one of the chip antenna modules further comprises a feed line surrounding pattern disposed between the first and third feed line dielectric layers and configured to at least partially surround the chip-antenna feed line.

5. The chip antenna module array of claim 4, wherein the at least one of the chip antenna modules further comprises feed line surrounding vias arranged to at least partially surround the chip-antenna feed line, and wherein each of the feed line surrounding vias electrically connects the feed line surrounding pattern and the ground pattern to each other.

6. The chip antenna module array of claim 2, wherein the at least one of the chip antenna modules further comprises:

a side feed line disposed between the first and third feed line dielectric layers and electrically connected to the connection member through the first feed line dielectric layer; and a side radiation pattern disposed between the first and third feed line dielectric layers and electrically connected to the side feed line.

7. The chip antenna module array of claim 1, wherein the at least one of the chip antenna modules further comprises:

a side feed line disposed between the ground pattern and the first feed line dielectric layer, and electrically connected to the connection member through the first feed line dielectric layer; and a side radiation pattern electrically connected to the side feed line and disposed closer to a side surface of the first patch antenna dielectric layer than to the side feed line.

8. The chip antenna module array of claim 7, wherein at least a portion of the side radiation pattern is disposed on the side surface of the first patch antenna dielectric layer or a side surface of the first feed line dielectric layer.

9. The chip antenna module array of claim 8, wherein the side radiation pattern is electrically connected to the solder layer.

10. The chip antenna module array of claim 1, wherein the patch antenna pattern comprises a first patch antenna pattern and a second patch antenna pattern, wherein the at least one of the chip antenna modules further comprises:

a third patch antenna dielectric layer disposed on an upper surface of the first patch antenna pattern; and a second patch antenna dielectric layer disposed between the first and third patch antenna dielectric layers, and wherein the second patch antenna pattern is disposed on an upper surface of the third patch antenna dielectric layer.

11. The chip antenna module array of claim 1, wherein the first feed line dielectric layer includes a ceramic material and has a dielectric constant higher than a dielectric constant of an insulating layer of the connection member.

12. The chip antenna module array of claim 11, wherein the first patch antenna dielectric layer has a dielectric constant higher than the dielectric constant of the first feed line dielectric layer.

13. The chip antenna module array of claim 1, wherein the connection member forms a space in which an integrated circuit (IC) is disposed, and wherein the feed via of each of the chip antenna modules is electrically connected to the IC through the connection member.

14. A chip antenna module, comprising:

a first patch antenna dielectric layer;

a feed via extending through the first patch antenna dielectric layer;

a patch antenna pattern disposed on an upper surface of the first patch antenna dielectric layer and configured to be fed from the feed via;

a ground pattern disposed on a lower surface of the first patch antenna dielectric layer;

a chip-antenna feed line including first, second, and third parts connected to each other in series, disposed such that the second part is disposed on a lower surface of the ground pattern, and electrically connecting at least one connection member feed line and the feed via to each other;

a first feed line dielectric layer disposed on a lower surface of the second part;

a side feed line disposed between the ground pattern and the first feed line dielectric layer, and spaced apart from the chip-antenna feed line;

a side radiation pattern electrically connected to the side feed line and disposed closer to a side surface of the first patch antenna dielectric layer than to the side feed line; and a solder layer disposed on a lower surface of the first feed line dielectric layer.

15. The chip antenna module of claim 14, wherein at least a portion of the side radiation pattern is disposed on the side surface of the first patch antenna dielectric layer or a side of the first feed line dielectric layer.

16. The chip antenna module of claim 15, wherein the side radiation pattern is electrically connected to the solder layer.

17. The chip antenna module of claim 14, wherein the side radiation pattern has a resonant frequency lower than a resonant frequency of the patch antenna pattern.

18. The chip antenna module of claim 14, further comprising:

a third feed line dielectric layer disposed between the ground pattern and the first feed line dielectric layer; and a second feed line dielectric layer disposed in contact with at least a portion of the chip-antenna feed line, wherein the side radiation pattern is disposed between the first and third feed line dielectric layers.

19. The chip antenna module of claim 14, further comprising:

a second patch antenna dielectric layer disposed on an upper surface of the first patch antenna dielectric layer; and a third patch antenna dielectric layer disposed on an upper surface of the second patch antenna dielectric layer, wherein the patch antenna pattern comprises:

a first patch antenna pattern disposed between the first and third patch antenna dielectric layers; and a second patch antenna pattern disposed on an upper surface of the third patch antenna dielectric layer.

* * * * *